US005469985A

United States Patent [19]

Furuichi et al.

[11] Patent Number: 5,469,985

[45] Date of Patent: Nov. 28, 1995

[54] STAINLESS STEEL CONTAINER WITH DEFORMATION PROTECTING DEVICE

[75] Inventors: Kazuo Furuichi, Yokohama; Tatsuya Gomi, Tokyo, both of Japan

[73] Assignees: Fujitechno Ltd., Tokyo; Suntory Limited, Osaka, both of Japan

[21] Appl. No.: 206,187

[22] Filed: Mar. 7, 1994

[30] Foreign Application Priority Data

| | | | |
|---|---|---|---|
| Mar. 12, 1993 | [JP] | Japan | 5-052504 |
| Mar. 19, 1993 | [JP] | Japan | 5-060588 |
| Apr. 6, 1993 | [JP] | Japan | 5-079585 |
| Jun. 23, 1993 | [JP] | Japan | 5-151789 |
| Jan. 20, 1994 | [JP] | Japan | 6-004523 |
| Jan. 28, 1994 | [JP] | Japan | 6-008327 |
| Jan. 31, 1994 | [JP] | Japan | 6-009596 |
| Feb. 14, 1994 | [JP] | Japan | 6-017607 |

[51] Int. Cl.[6] ..... B65D 25/24

[52] U.S. Cl. ..... 220/632; 220/628; 206/509

[58] Field of Search ..... 206/509; 220/608, 220/609, 628, 632, 636, 649, 605, 756, 768, 771, DIG. 1

[56] References Cited

U.S. PATENT DOCUMENTS

| | | | |
|---|---|---|---|
| 1,992,378 | 2/1935 | Lewis | 220/771 |
| 2,592,797 | 4/1952 | Erickson | 220/771 |
| 3,334,714 | 8/1967 | Gordon | 220/771 |
| 3,516,573 | 6/1970 | Mizuk | 220/608 |
| 3,840,141 | 10/1974 | Allom et al. | 220/628 |
| 4,010,867 | 3/1977 | Jones | 220/608 |
| 4,282,974 | 8/1981 | Quandel | 220/DIG. 1 |
| 4,372,458 | 2/1983 | Carlson | 220/632 |
| 4,573,603 | 3/1986 | Starling et al. | 220/605 |
| 4,625,881 | 12/1986 | Carlson | 220/632 |

FOREIGN PATENT DOCUMENTS

| | | | |
|---|---|---|---|
| 2823675 | 12/1978 | Germany | 220/632 |
| 1127305 | 9/1968 | United Kingdom | 220/649 |

*Primary Examiner*—Stephen J. Castellano
*Attorney, Agent, or Firm*—Kanesaka & Takeuchi

[57] ABSTRACT

The container of the present invention includes a rubber protector. The rubber protector is annularly fitted to at least one of an upper end wall and a lower end wall of the container body and extends over the outer peripheral region of the end wall. The end wall is formed with an annular stepped portion by cold working and a radial protruded portion so that work-hardening of the stainless steel is formed to increase the strength of the end walls.

13 Claims, 22 Drawing Sheets

STAINLESS STEEL CONTAINER WITH DEFORMATION PROTECTING DEVICE

BACKGROUND OF THE INVENTION

1. Field of the Invention

The present invention relates to a stainless steel container having a rubber protector, which is used for storing beverage such as beer, etc.

2. Description of the Prior Art

As a container in which various kinds of beverages including beer are filled and which is intended to be used for storing in stationary place or transportation, a stainless steel container has been generally used. The upper and lower outer peripheral edges of a container body are fitted with ring shaped protectors, respectively. The protectors cover the periphery of an upper end wall and that of a lower end wall of the container body to protect end wall faces of the upper end wall and the lower end wall. In use, a lower protector provided at the lower end wall serves for a stand for stationarily placing the container and an upper protector provided at the upper end wall serves for a supporting base for a container to be piled above.

The protector has been conventionally manufactured by mainly using a stainless steel material which is the same one as the container body. The stainless steel protectors have been usually welded to an upper peripheral edge and a lower peripheral edge of the stainless steel container body which has been worked under deep-drawing. Another example the protector is that an upper end wall and a lower end wall are welded to a lower inner peripheral face and an upper inner peripheral face of a stainless steel cylinder so that the upper end wall overhangs upwardly and the lower end wall overhangs downwardly to form protector portions.

In either cases of the above, when a protector is made from a stainless steel, it is stout and good-looking. However, when, for example, draft beer is filled in a container, the weight of the container becomes considerably heavy. Thus, when a container is erroneously dropped at the time of loading-in or loading-out of containers to be transported or the container is striken hard against a floor, not only a noise is given forth, but also the container is deformed or damaged. Especially, when the container is dropped in an inclined state, the protector is locally deformed, so that the container can not be stably placed at a normal upstanding posture and it becomes difficult to pile another container thereon.

In order to solve the above problems, it is considered to use a ring-shaped rubber protector as a protector. Japanese Design Registration No. 635034 (a keg to be used for transportation) discloses this example, i.e., rubber protectors are fitted to an upper portion and a lower portion of a container body, as shown in FIG. 23.

In FIG. 23, when a rubber protector is used, it is necessary to provide a certain thickness to a ring-shaped portion for maintaining strength. Accordingly, protectors 61 must be fixed on a smooth curved surface of an upper end wall 63 of a container body 62 and that of a lower end wall 64 of the container body 62, respectively. Since a keg shown in FIG. 23 is a relatively long and slender container and the areas of the upper end wall 63 and the lower end wall 64 are small, there may be no special problem in a point of strength. However, when this keg is used as a beer keg and a container body is formed by deep-drawing a stainless steel plate, a girth or shell portion of the container is hardened during the working, so that the strength of the girth portion is remarkably increased. However, strains are not formed on the end wall faces of the upper and lower end walls which become fitting portions of the protectors and thus, there is no change in strength when compared with that of a stainless steel plate which is unworked.

When a rubber protector 70 is fitted to an end wall face 71 of the upper or lower end wall in a state such that the strength is low as shown in FIG. 24, the end all face 71 of the upper or lower end wall is easily depressed like a portion 71' by load applied thereto in the perpendicular direction at the piling step of the kegs or by impingement to the rubber protectors when the keg is turned over. According to a degree of depression, the form of the rubber protector 70 gets out of shape to result in useless as the container. Moreover, the container can not be placed stably.

As another example, in a case here a ring-shaped protector is used, an inner peripheral edge **70*a* of a protector 70 as shown in FIG. 24 is extended in the central direction to be fixed smoothly to a smooth curved face of an end wall face 71. As a result, there occurs such a problem that as the end of an inner edge of the protector 70** becomes thin in thickness, the end of an inner edge is easily deteriorated, and it is liable to be come off due to an insufficient adhesion.

SUMMARY OF THE INVENTION

The object of the present invention is to provide a stainless steel container having end wall faces to which rubber protectors are fitted, wherein the end wall faces do not deform easily.

Another object of the invention is to provide a stainless steel container, an end wall face of which is not easily deformed by providing work-hardening of an austenite stainless steel in the end wall face inclusive of a fitting portion of a rubber protector.

Still another object of the invention is to provide a stainless steel container, in which a stainless steel protector is used as one of protector means and a rubber protector is used as the other thereof, and a work-hardening of an austenite stainless steel in the end wall face inclusive of a fitting portion of a rubber protector.

Still another object of the invention is to provide a stainless steel container, in which a stainless steel protector is used as one of protector means and a rubber protector is used as the other thereof, and a work-hardening is formed at an end wall face to which the rubber protector is fitted.

Still another object of the invention is to provide a stainless steel container, which is prevented from deformation by dispersing a force applied to a rubber protector.

Still another object of the invention is to provide a stainless steel container, which has a reinforcing treatment from an outside of an end wall face in a rubber protector, in addition to the work-hardening treatment in the end wall face.

Still another object of the invention is to provide a stainless steel container in which a hardness of an outer end surface of a rubber protector can be adjusted.

In case that an austenite stainless steel plate is formed into a first molded body and a second molded body of a predetermined shape by a deep-drawing work, a single stepped portion or multiple stepped portions which become ring-shaped rib is formed at an outer peripheral region of end wall faces of an upper end wall and a lower end wall, and protruded portions are formed in the outer peripheral direction from the center of the end wall faces to form radial ribs, whereby strains are generated by a cold working to increase the strength of the end wall faces. The ring-shaped ribs support the rubber protector and prevent the depression in the circumferential direction applied to an outer peripheral portion of the end wall faces by vertical load. The radial ribs prevent the depression of the end wall faces at the inner peripheral portion by bending of the rubber protector or shear load.

In a case that a rubber overhanging portion is provided in an opening portion of a protector as a handle for a transportation of a container or a draining purpose, the overhanging portion disperses loads applied to the neighbourhood of the opening portion of the protector to prevent the depression of the end wall faces.

In a case that a reinforcing plate is placed on an end wall face as a reinforcing treatment at the outside of the end wall face and a rubber protector is fitted thereto, a force applied to the rubber protector is supported by the reinforcing plate and is dispersed. Thus, even though a local force is applied to the rubber protector, a specific part of the end wall face which supports the protector is not depressed.

In a case that a beam or girder which is provided so as to stand-up on the end walls can support an end wall face from the outside to increase the strength of the end wall face, a depression is not caused on the end wall face. As the beam is embedded in the rubber portector, it does not appear on the outer face of the protector.

In a case that a reinforcing material is applied to a beam, when a local force is applied to the rubber protector, the reinforcing material supports the inside of the beam to disperse the local force, so that the depression of the end wall face by a local deformation of the beam is prevented.

Moreover, at a time of molding a rubber protector, if a shoe which is different in hardness from that of the rubber protector is mounted on a face contacting the rubber protector, friction resistance at a stand or at a supporting base can be adjusted according to the hardness of the shoe.

BRIEF DESCRIPTION OF THE DRAWINGS

FIGS. 19*a* and 19*b* show a problem caused by deformation of a beam, wherein FIG. 19*a* is a principal part showing a fitting portion of a protector and FIG. 19*b* is a plan view showing a part of a lower end wall portion.

DETAILED DESCRIPTION OF PREFERRED EMBODIMENTS

Figure 1A:
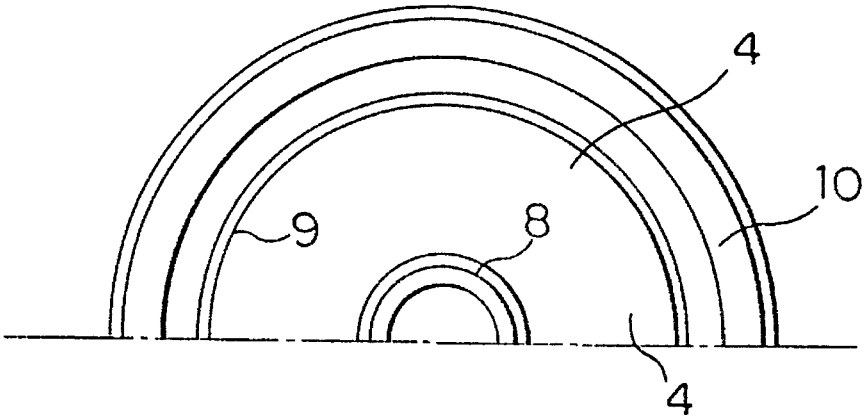
FIG. 1*a* is a plan view showing a part of a beer keg provided with a rubber protector of Example 1 of the present invention.
Figure 1B:
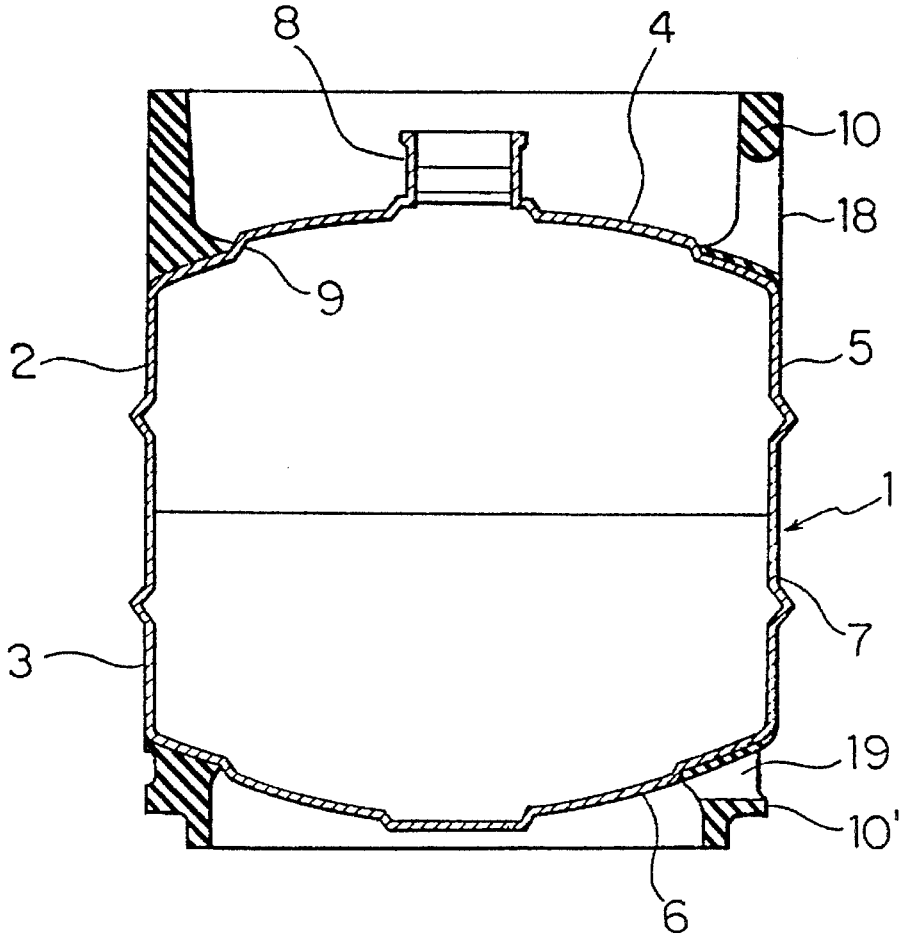
FIG. 1*b* is a cross-sectional view thereof.

Example 1 of the present invention is explained referring to the drawings. FIGS. 1*a* and 1*b* show a beer keg for transportation to which the present invention is applied. In Example 1, a container body 1 is prepared by the combination of a first molded body 2 and a second molded body 3. The both molded bodies 2 and 3 are formed by deep-drawing a plate of austenite stainless steel under cold working. The first molded body 2 is integrally formed in a shape such that an upper end wall 4 and a cylindrical upper girth or shell portion 5 are provided. The second molded body 3 is integrally formed in a shape such that a lower end wall 6 and a cylindrical lower girth or shell portion 7 are provided. The upper girth portion 5 and the lower girth portion 7 are connected to each other at their cylindrical opening edges to form a girth portion of the container body 1 and to thereby provide a hollow container having the upper end wall 4 and the lower end wall 6. The above-mentioned manufacturing process is the same as the conventional process of manufacturing a container body. At a center of the upper end wall 4 is fitted a mouthpiece 8. The above-described constitution is applied to the other examples of the present invention.

Figure 1C:
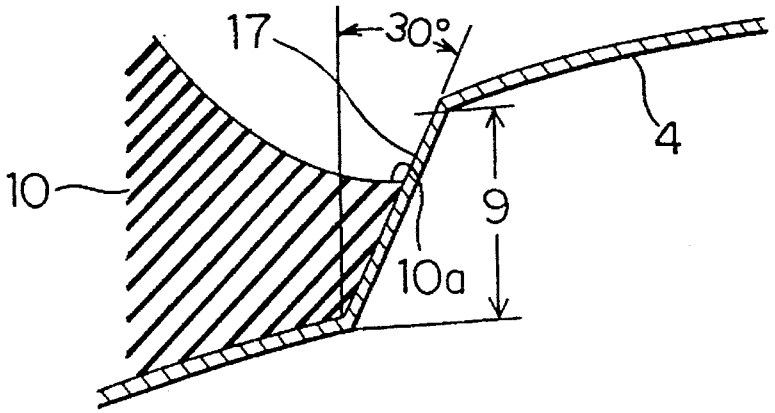
FIG. 1*c* is an enlarged view of a part in FIG. 1*b* in which an inner peripheral edge-fitting portion of the rubber protector is shown.

In Example 1, an end wall face of the upper end wall 4 or the lower end wall 6 is step-worked to form an upper side and an lower side. Referring to the upper end wall 4, as shown in FIG. 1*c*, the end wall face stepped at the upper side and the lower side is formed by providing an annular stepped portion 9. The stepped portion 9 stands up in the axial direction, with an inclined surface 17 which is provided at an outer peripheral portion of a crown face, i.e., the end wall face of the upper end wall 4, in such a manner that it is inclined at an angle of about 30° with a certain width. A smooth curved face of the lower stepped portion to which the inclined surface 17 of the stepped portion 9 continues is bent at an outer peripheral edge of the upper end wall 4 so as to be connected to the cylindrical upper girth portion 5. An annular rubber protector 10 is fitted in such a manner that it extends from an end of the upper girth portions to a middle of the upper peripheral end wall 4 with the hardened portion. An inner peripheral edge 10*a* of the rubber protector 10 is received within the region of a standing-up portion of the stepped portion 9.

Figure 2:
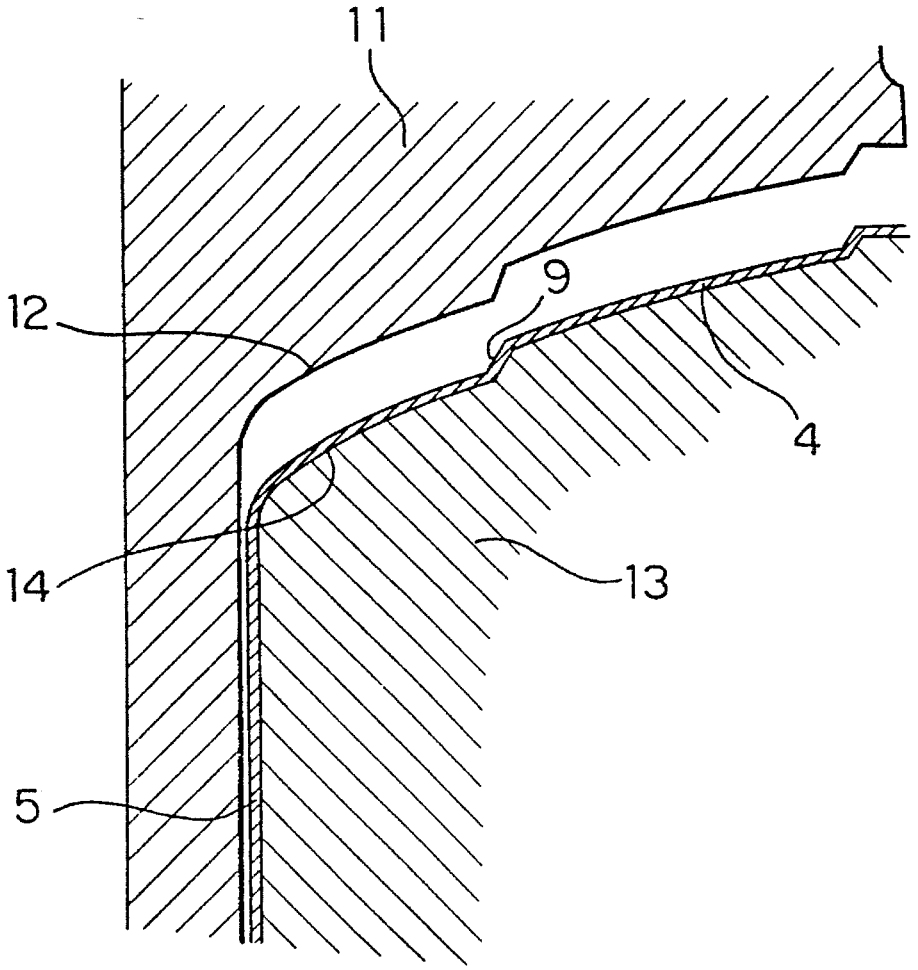
FIG. 2 is a view showing a treatment in forming a stepped portion.

In forming of the stepped portion 9, for example, when the first molded body 2 is formed by a mold under cold working, an upper mold 11 and a lower mold 13 are used as shown in FIG. 2. An annular projected edge 12 is formed on the upper mold 11 at its upper end wall-molding face. 0n the other hand, an annular recessed portion 14 is formed on the lower mold 13 at the position corresponding to the annular projected edge 12. When a stainless steel plate is deep-drawing under pressure between the upper mold 11 and the lower mold 13, a plate face of the upper end wall 4 is worked along the shapes of the projected edge 12 and the recessed portion 14 in such a manner that the inner peripheral side and the outer peripheral side of the worked stainless steel plate is worked to have up-and-down steps. At an outer peripheral region of the upper end wall 4 is formed the stepped portion 9 in an inclined state and a work-hardening is conducted by rapid up-and-low strains of the stepped portion 9, so that the strength of the region around the stepped portion 9 inclusive of the stepped portion 9 is increased to from a ring-shaped rib. The inclined surface 17 of the stepped portion 9 and a smooth curved faces at the upper and lower sides are connected by curved edges having small radius.

Figure 4A:
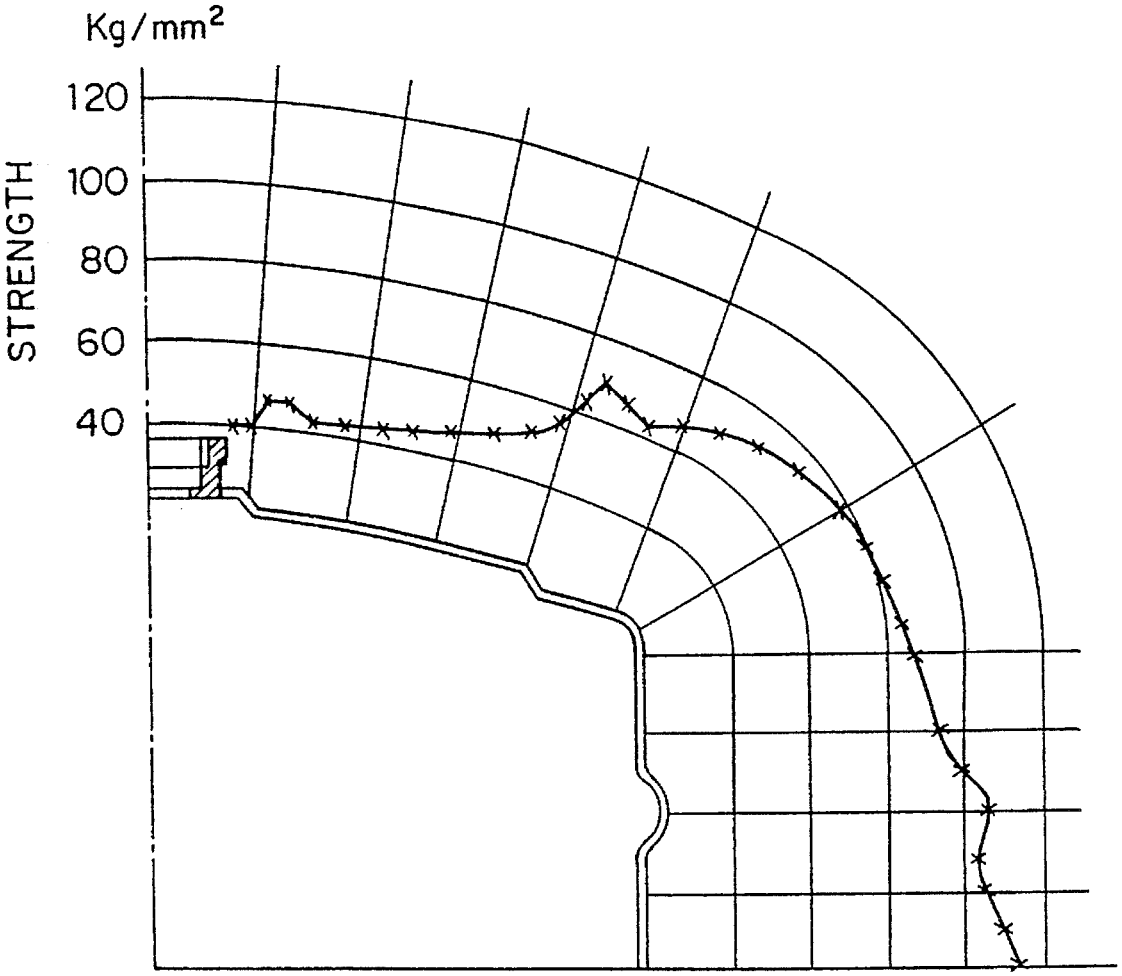
FIG. 4*a* is a view showing strength distribution on an end wall face according to Example 1 and FIG. 4*b* is a view showing strength distribution on an end wall face of a comparative example.
Figure 4B:
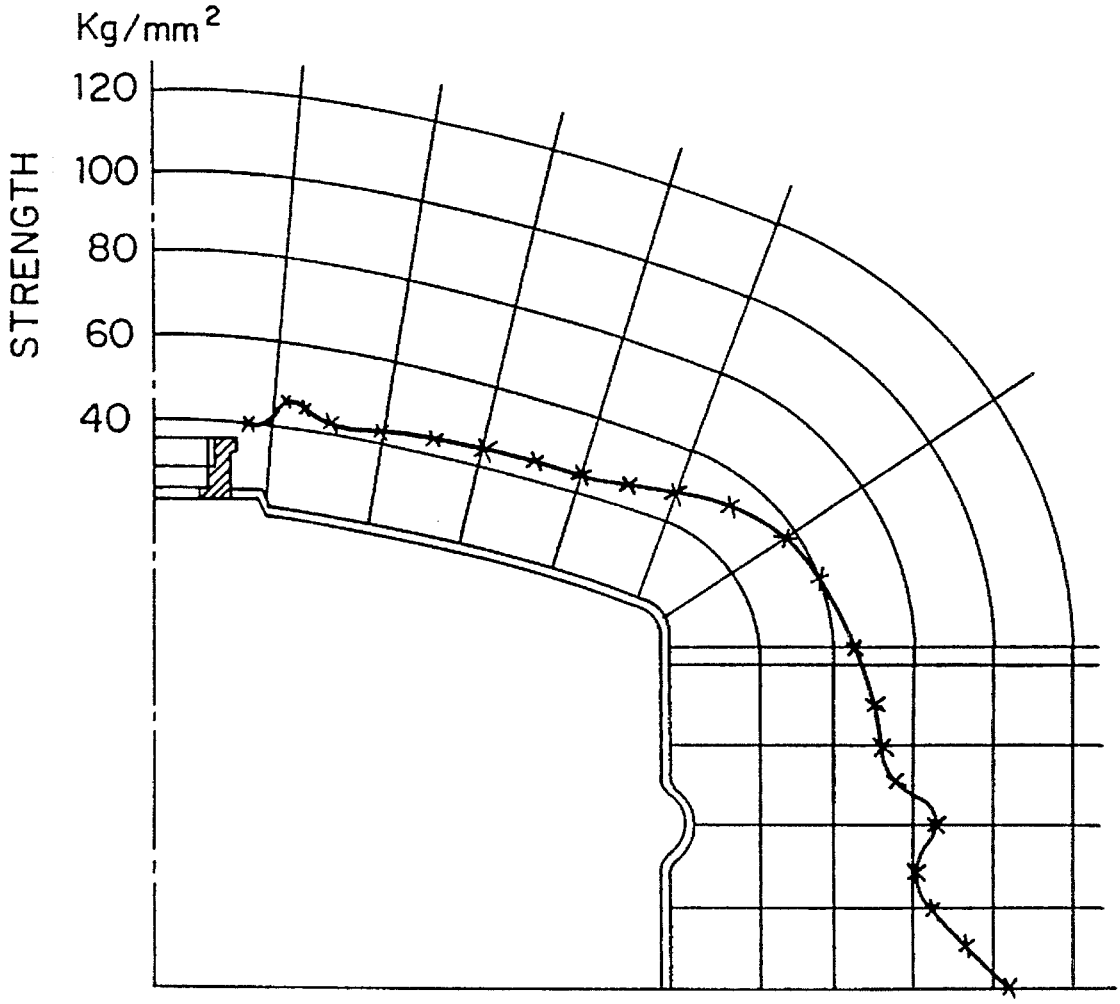
FIG. 4b PRIOR ART

FIGS. 4*a* and 4*b* show strength of the portions along the shapes of container bodies with or without an annular stepped portion.

FIG. 4*a* is an example according to the present invention and FIG. 4*b* is a comparative example. The molded body of the container body according to the comparative example is also cold-worked by deep-drawing of a stainless steel plate to form a shape having upper and lower portions and a cylindrical portion forming a part of a girth portion. However, an end wall face of the comparative example does not have an annular stepped portion and has a smooth curved face. The material of the both container bodies is SUS-304. The plate has 1.5 mm in thickness, 35 kg/mm$^2$ in strength. The diameter of the girth portion is 400 mm and the radius of curvature of the end wall face is 400 mmR.

As apparent from the drawings, according to the example of the present invention, the strength of the stepped portion increases more than 70 kg/mm$^2$ and the strength of areas front and behind the end wall face inclusive of the stepped portion and the girth portion remarkably increases in comparison with those of the comparative example.

Figure 3:
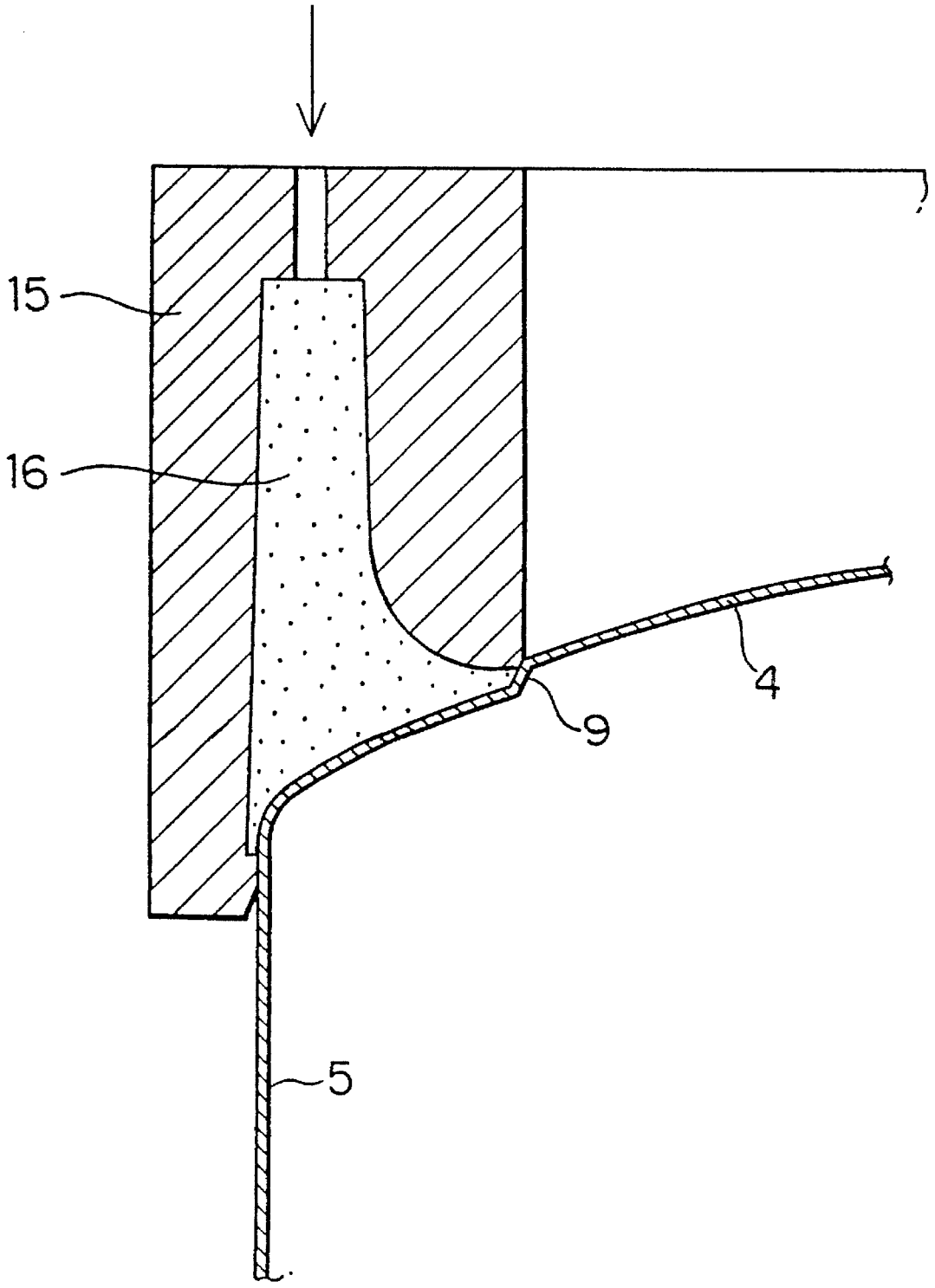
FIG. 3 is a view showing a treatment of fitting a rubber protector.

When a rubber protector 10 is fitted, an adhesive is applied to the end wall face and, as shown in FIG. 3, a metal mold 15 for injection set so that it covers over the stepped portion 9 formed on the upper end wall 4 and an upper edge of an upper girth portion 5. A vicous rubber 16 which is not vulcanized is injected through an aperture defined in the metal mold 15 to the outer end portion of the upper end wall 4.

At that time, as shown in FIG. 1*c*, the inner peripheral edge 10*a* the rubber protector 10 is received within a standing-up portion of the stepped portion 9 to fix to the inclined surface 17. By this structure, the inner peripheral edge of the rubber protector 10 is held within the range of the height that the stepped portion stands up with a certain thickness at the edge end of the inner peripheral edge, whereby sufficient fixing strength can be obtained.

An opening portion 18 which is used as a handle for transporting carrying is formed at an appropriate portion of the peripheral face of the rubber protector 10 which is fitted as an upper protector. The opening portion 18 is also used as a draining hole through which a water on the end wall is removed.

The process of forming a stepped portion 9' on the lower end wall and fitting a rubber protector 10' thereto is entirely the same as that for the upper end wall 4. The rubber protector 10' fitted at the lower protector is provided with an opening portion 19 for drainage of water collected on the end wall face at the time of storing the container in an inverted posture.

After an unvulcanized rubber 16 is heated and hardened in a condition as shown in FIG. 3, the metal mold 15 for injection is released to obtain a beer keg as shown in FIG. 1. In this example, the formation of the stepped portions on the upper end wall 4 and the lower end wall 6 may be conducted at the same time of the deep-drawing work of the first molded body 2 and the second molded body 3 or separately therefrom. Moreover, it is possible to assemble a container body by welding the intermediate girth or shell between the first molded body and the second molded body. Further, either one of the upper and lower rubber protectors may be substituted for a stainless steel protector.

Figure 5A:
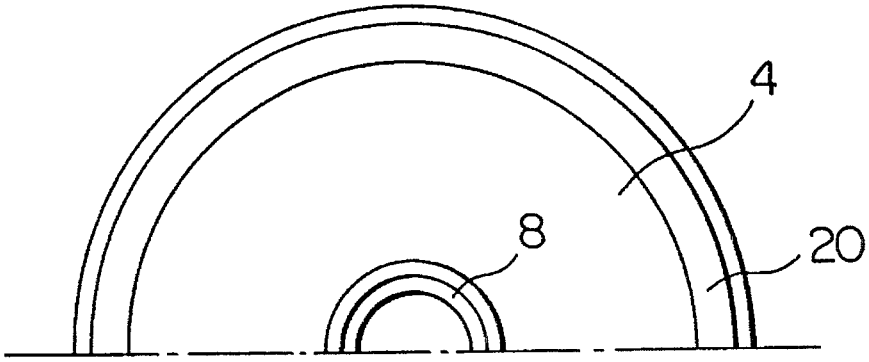
FIG. 5*a* is a plan view of a part of a beer keg shown in another modification of Example 1.
Figure 5B:
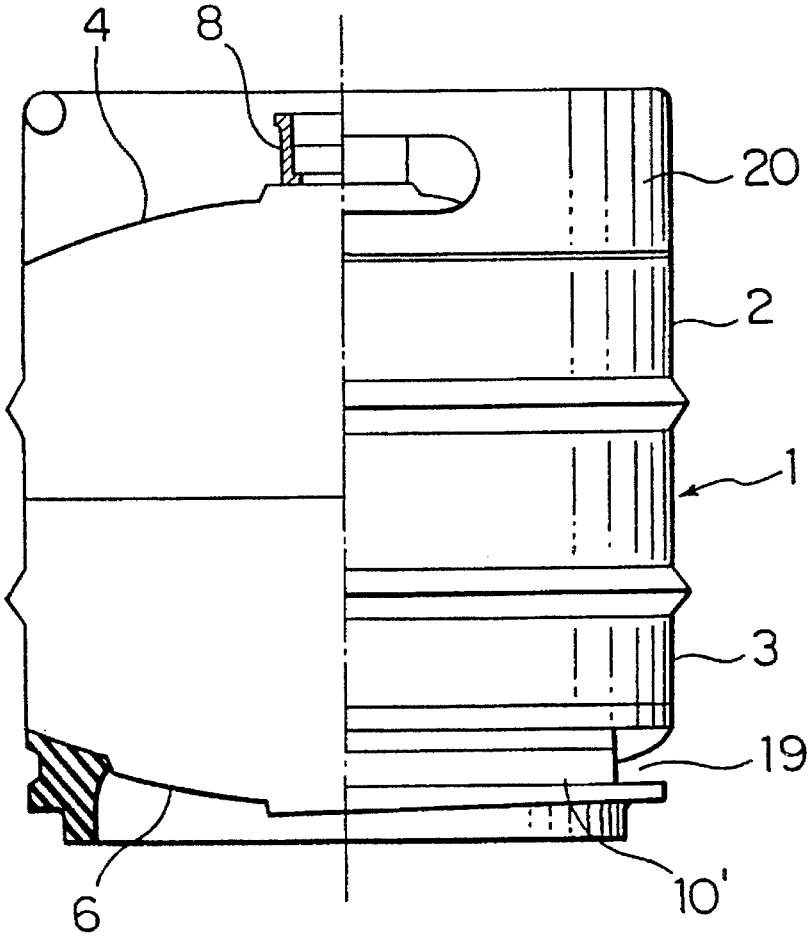
FIG. 5*b* is a partial sectional front view thereof.
Figure 5C:
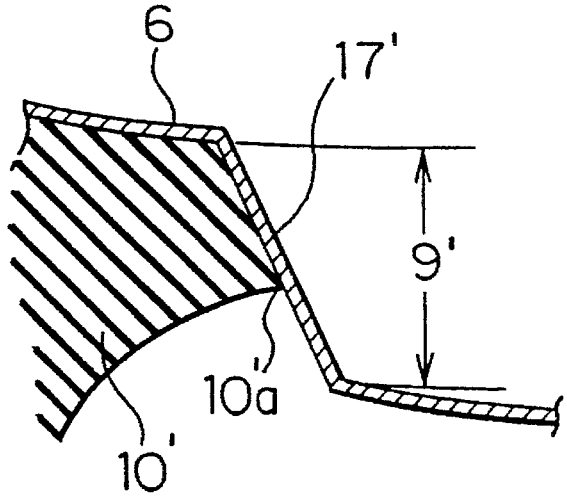
FIG. 5*c* is an enlarged view of a part in FIG. 5*b*.

In a case that the rubber protector is used in either one of the upper and lower protectors, it is general to apply the rubber protector to the lower protector which becomes a stand for the container. However, there is no problem to use the rubber protector for the upper protector. When the rubber protector is used for the lower protector, as shown in FIGS. 5*a* and 5*b*, an annular stainless steel protector 20 as the upper protector is welded to the upper edge of the upper girth portion 5 of the first molded body 2 so as to cover the circumference of the upper end wall 4. The rubber protector 10' as the lower protector is fixed to cover the lower end wall 6 of the second molded body 3 and the lower edge of the lower girth portion 7 in the same manner described in FIG. 3. As shown in FIG. 5*c*, the inner peripheral edge 10*a'* of the rubber protector 10' is received on an inclined surface 17' of a standing-up portion of the stepped portion 9' which stands up on the outer peripheral side of the lower end wall 6 in the same manner described above. In this example, however, it may omit the stepping work of an end wall face because no load is added to the end wall face of the upper end wall from the upper protector as the upper protector is the stainless steel protector.

According to this example, as the end wall face on which the rubber protector is fitted is made with deformation-prevention treatment by work-hardening, the container body is not easily deformed by an external force applied via the rubber protector. It is possible to obtain a certain thickness at the end of the inner peripheral edge of the rubber protector within the region of the standing-up height of the stepped portion to thereby increase the fixing strength and to prevent a separation as well as to inhibit aging. The end of the inner peripheral edge of the rubber protector can be treated finely.

Figure 6A:
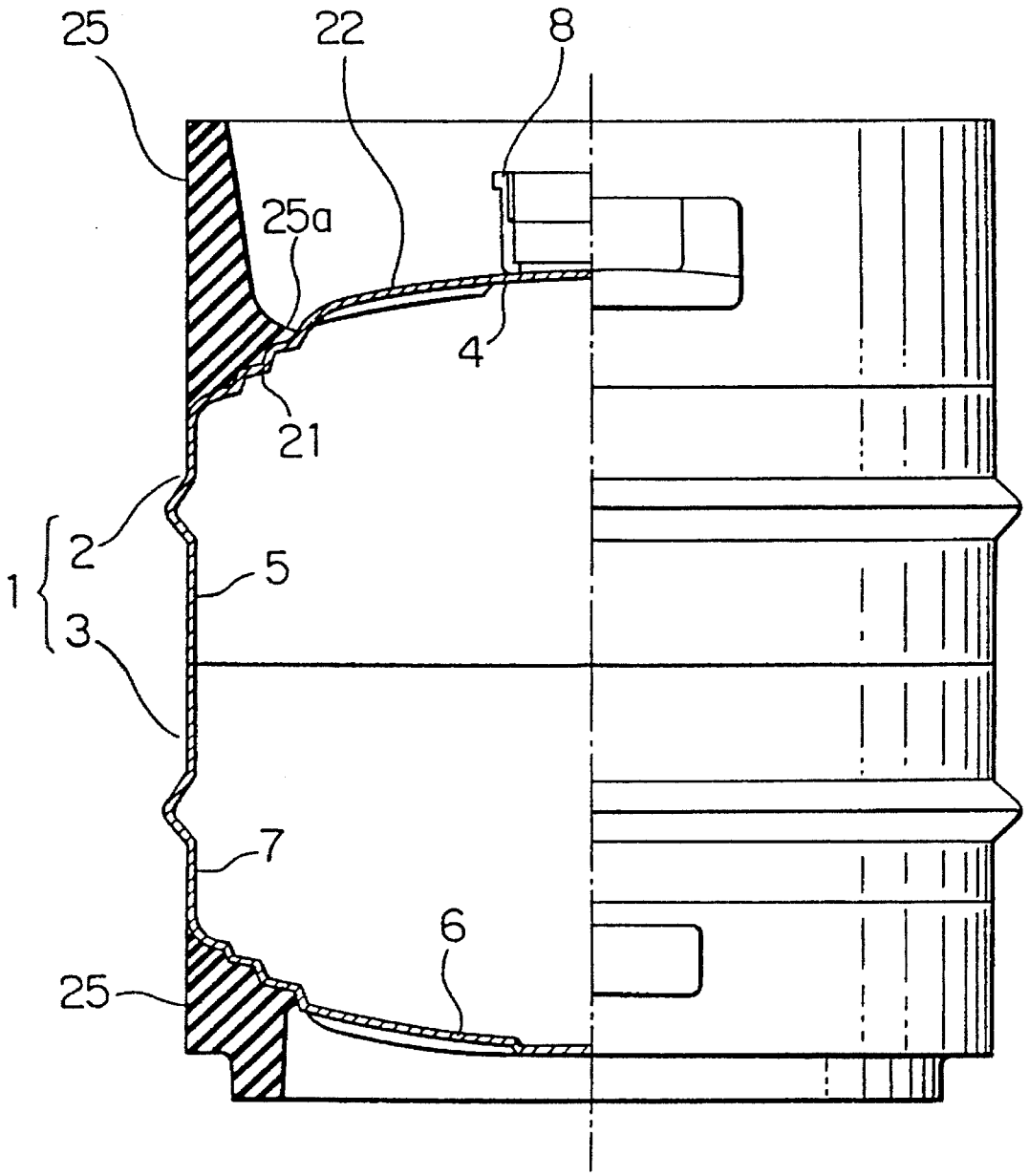
FIG. 6*a* is a partial sectional front view showing Example 2 of the present invention and FIG. 6*b* is an enlarged view showing a fitting portion of a rubber protector.
Figure 6B:
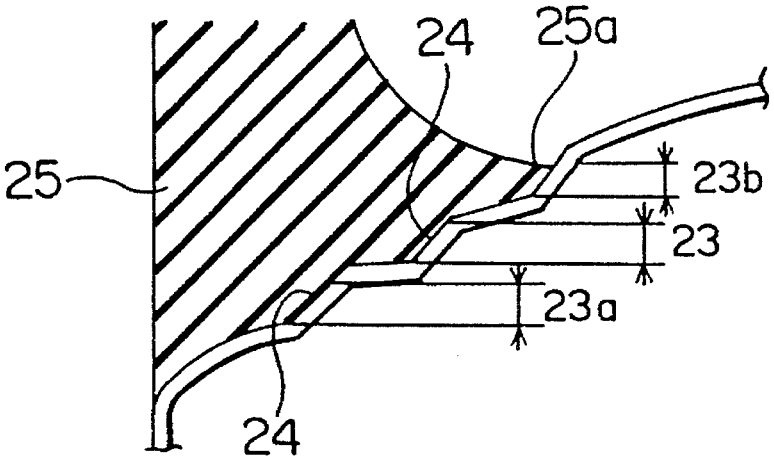

Example 2 has, as shown in FIGS. 6*a* and 6*b*, a structure such that a ring-shaped rib 21 having multiple stepped portions which form a fitting face of a rubber protector 25, and radial ribs 22 are formed on end wall faces of the upper end wall 4 and the lower end wall 6 at the same time when the molded body is mold-worked.

Figure 7A:
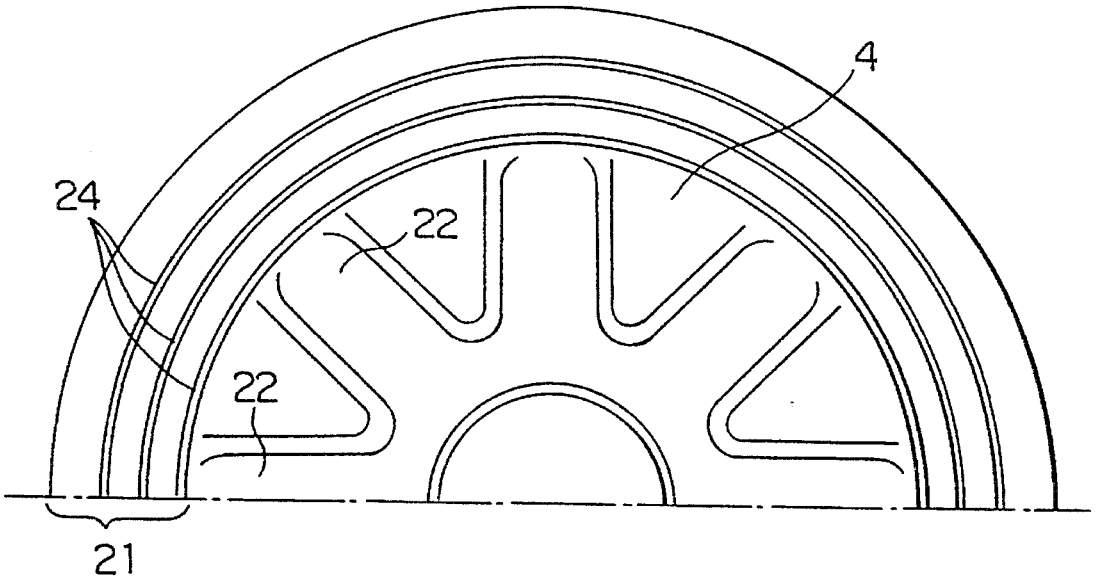
FIG. 7*a* is a plan view showing a part of an upper end wall portion of Example 2.
Figure 7B:
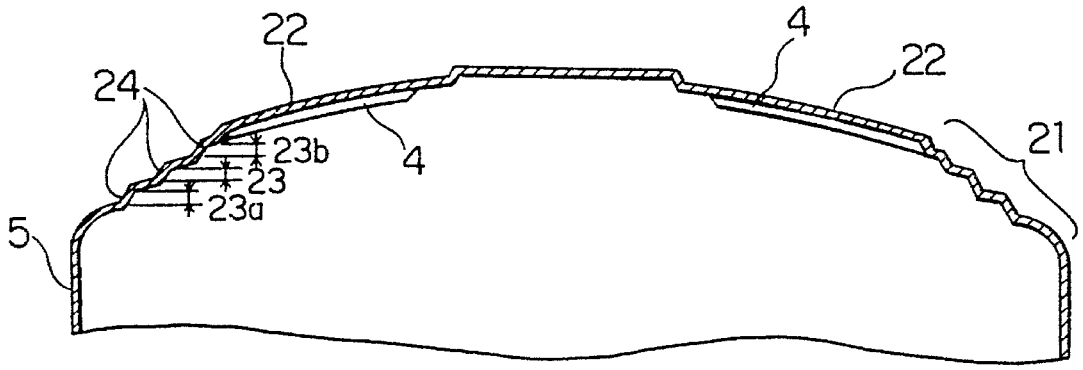
FIG. 7*b* is a longitudinal sectional view of FIG. 7*a*.

FIGS. 7*a* and 7*b* show a molding shape of the upper end wall 4. In these drawings, a ring-shaped rib 21 is constituted by a plurality of annular stepped portions 23 concentrically formed more than two at the inside and outside over a certain range of the outer peripheral region of the upper end wall 4. Each stepped portion 23 stands up to a certain height in the axial direction with an inclined surface 24 inclined at an angle of about 30° with a certain width and extends to a smoothly curved face, which is connected to a next stepped portion at a side of inner periphery. A smooth curved face which continues from a stepped portion 23*a* at the most outer periphery is bent at an outer peripheral edge of the upper end wall 4 to continue to a cylindrical upper girth portion 5. The ring-shaped rib 21 increases the strength in the circumferential direction at a certain region of the outer peripheral portion of the end wall face by the formation of the multiple stepped portions.

The radial ribs 22 are protruded portions which are formed by radially protruding a part of the end wall face between a mouthpiece 8 provided at the center of the upper end wall 4 and the stepped portion 23*b* at the most inner peripheral side of the ring-shaped rib 21. Although the number of the protruded portion is not especially limited, eight protruded portions are radially formed around the fitting portion of the mouthpiece 8, in this example. Moreover, any shape of the protruded portions is possible if it is possible to increase the strength of the end wall face by hardening in the radius direction from the center of the end wall face towards the periphery under cold work.

Figure 8C:
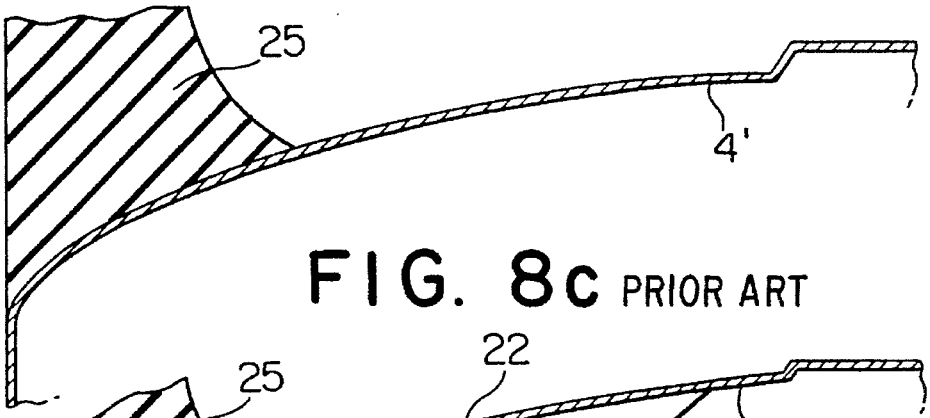
FIG. 8c PRIOR ART
FIG. 8*c* is a cross section of the end wall of a comparative example.
Figure 8B:
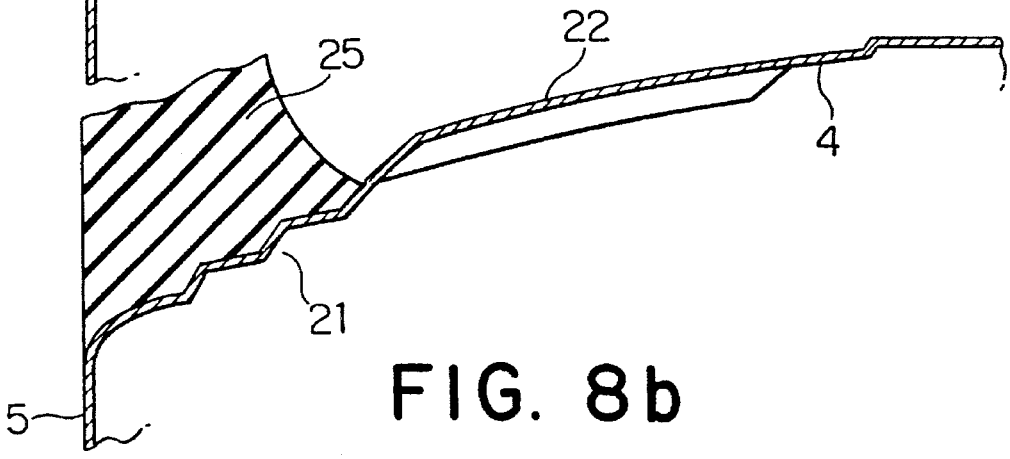
FIG. 8*b* is a cross section of the end wall of Example 2.
Figure 8A:
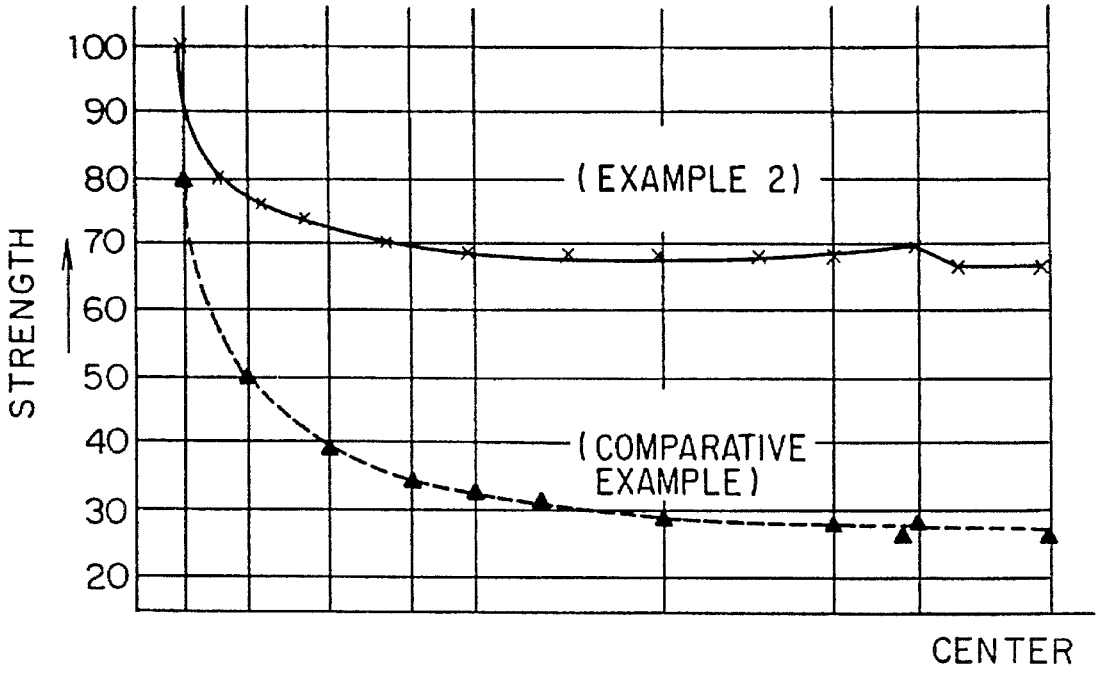
FIG. 8*a* is a graph showing a comparison of a strength of an end wall face of a container of the Example 2 and that of an end wall face of a comparative example.

FIGS. 8*a* to 8*c* show comparison of strength in related parts of an end wall 4' of the conventional container (FIG. 8*c*) and those of the end wall 4 of the container (FIG. 8*b*) according to the example of the present invention. FIG. 8*a* shows the proportion of changes of vertical load at the portions with respect to strength 100 at the outer peripheral edges of the end walls 4 and 4' shown in FIGS. 8*b* and 8*c*. The material of the end wall is SUS-304; plate thickness is 1.5 mm; diameter is 400 mm and radius of curvature of the end wall is 400 mmR.

According to this example, strength more than about 70% is kept in the forming region of the ring-shaped rib 21 as shown in Example 2 in FIG. 8*a*. Although the strength is decreased at the forming region of the radial rib 22, strength of more than 65% is maintained at the minimum.

In the end wall 4' of the comparative example as shown in FIG. 8*c*, which is not provided with a ring-shaped rib and a radial rib, the strength does not exceed the point of 80% even at the outer peripheral edge of the end wall as shown in Comparative Example in FIG. 8*a*. As the distance decreases toward the center direction, the strength drops to 30% and the strength lowers to 25% at the center portion of the end wall 4'.

A rubber protector 25 extends over the end wall face at the ring-shaped rib 21 and an upper edge of an upper girth portion 5. An inner peripheral edge 25*a* of the rubber protector 25 extend to a stepped portion 23*b* at the most inner periphery of the ring-shaped rib 21 similar to Exmaple 1 and the thickness is within the range of the standing-up height of the stepped portion.

The formation of the ring-shaped rib 21 and the radial ribs 22 in the lower end wall 6 and the fitting method of a rubber protector are the same as those in the upper end wall.

It is possible to fabricate the container body by welding an intermediate girth between the first molded body and the second molded body. Moreover, either one of the upper and lower rubber protectors may be replaced by a stainless protector.

In a case that a rubber protector is used in either one of the upper and lower protectors, for example, when the rubber protector is used to the lower protector which becomes a stand for the container, an annular stainless steel protector (not shown) is welded on an upper girth portion of the first molded body to cover the circumference of the upper end wall. Then, in the same way of FIG. 6*a*, the rubber protector is fitted on a region extending from a lower edge of the lower girth portion 7 to a middle of the lower end wall 6 with the hardened portions. The inner peripheral edge of the rubber protector is located on an inclined surface of a standing-up portion of the stepped portion of the lower end wall 6 and fixed thereat in the same way described above.

By forming the ring-shaped rib 21 and the radial ribs 22 on the end wall face, the strength of the end wall face increases as a whole. However, by forming the ring-shaped rib 21 at the outer peripheral region which becomes a fitting face of the rubber protector 25 and by forming the radial ribs 22 at the central region at which the rubber protector 25 are not fitted, a vertical load from the rubber protector 25 on the ring-shaped rib 21 can be supported so that a depression caused in the circumferential direction can be prevented. Moreover, it can inhibit a pressure caused by inward bending of the rubber protector, by supporting the main portions of the ring-shaped rib 21 from the radial direction with the radial ribs 22, or a depression caused in the radial direction of the end wall face by a shearing force which is applied to the end wall face.

As described above, according to the present example, as a ring-shaped rib is formed on the end wall face of the end wall to which a rubber protector is fitted as a deformation-preventing treatment and radial ribs which support the ring-shaped rib from the central direction are formed on the end wall face, the strength of the end wall increases as a whole and a depression is not caused by an external force which is applied to the end wall via rubber protector and therefore, a stainless steel container which is not deformed even in the long-period of use can be provided.

Figure 9A:
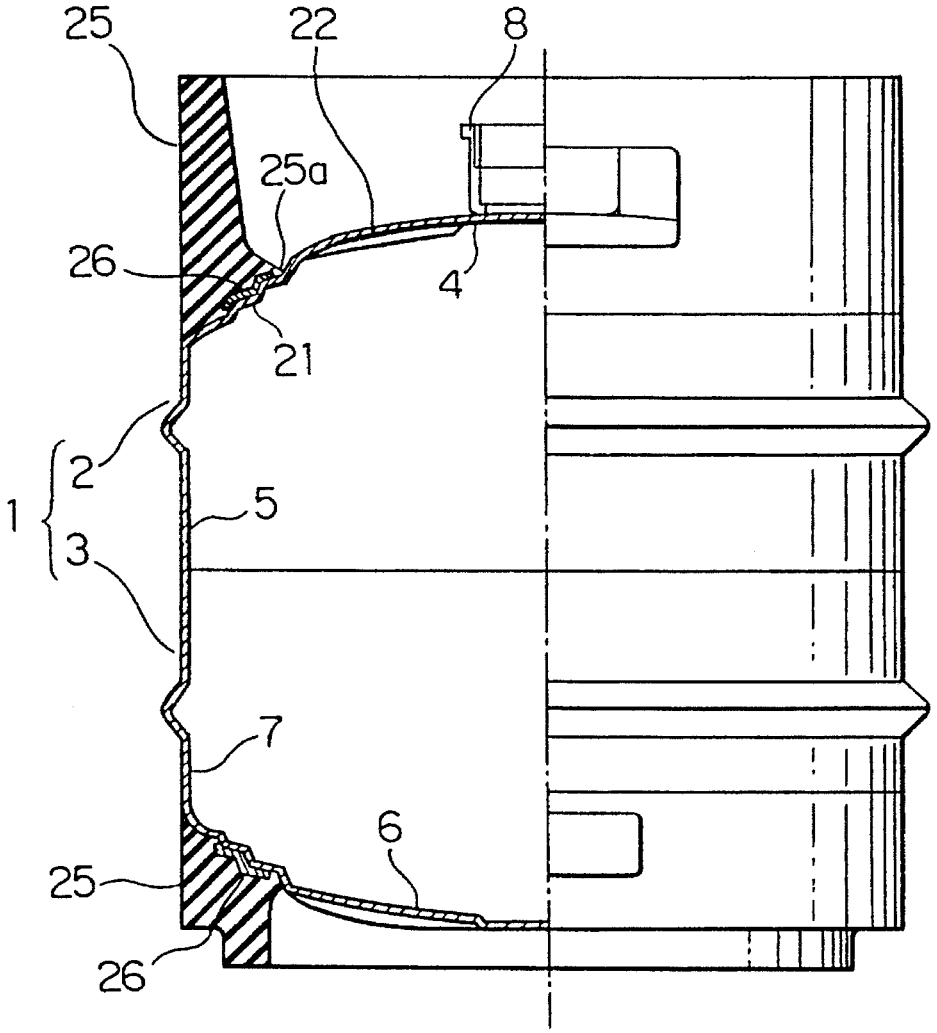
FIG. 9*a* is a partial sectional front view of a container, in which a reinforcing plate is embedded in a rubber protector.

On top of the work-hardening of the end wall face, a reinforcing treatment can be added to prevent the depression of the end wall face caused by local deformation of the protector itself. FIG. 9*a* shows an example in which a reinforcing plate 26 is piled on the end wall face of the container shown in FIG. 6*a*.

Figure 9B:
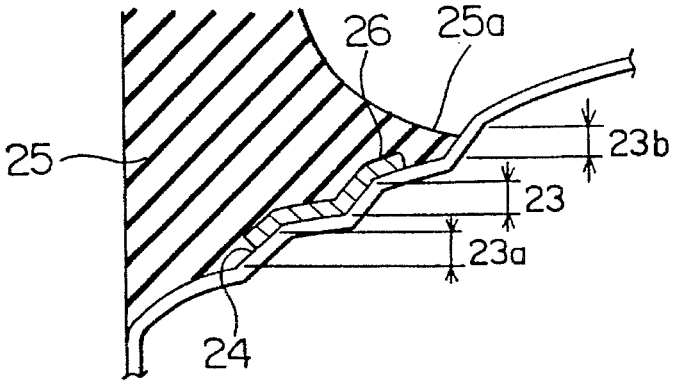
FIG. 9*b* is an enlarged view showing a fitting portion of a rubber protector.

The reinforcing plate 26 is, as shown in FIG. 9*b*, an annular or an arc-shaped segment which is worked in a corrugated shape with concentric steps. The reinforcing plate 26 is piled and fitted on the end wall face and is embedded in the inner peripheral region of the rubber protector 25. It is desirable to set up a stepped portion to be formed in the reinforcing plate 26 in the same pitch as that of the stepped portion of the ring-shaped rib formed on the end wall face. By this formation, the reinforcing plate 26 can be tightly applied on the end wall face. In this connection, in order to keep a gap between the reinforcing plate 26 and the end wall face at a certain space, a project (not shown) may be formed at an appropriate portion of the reinforcing plate 26 and this project may be placed on the end wall face.

In this case, at the time of forming the rubber protector, rubber enters into the above-mentioned gap to locate the reinforcing plate 26 in the rubber protector 25 at the position near the end wall face, whereby filling rubber in the space of the gap while excluding air in the gap between the reinforcing plate 26 and the end wall 4.

The reinforcing plate may be formed of any material and have a desired thickness if a certain strength is possessed. However, it is desirable to use FRP. FRP has light weight and has resiliency, is excellent in restoration and is not broken like a metal.

By piling the above-mentioned reinforcing plate 26 on the fitting portion of the rubber protector 25, even though a local force is applied to the rubber protector 25 when the container is dropped or fallen down, such a force is dispersed at the reinforcing plate 26 and thus, a depression is not formed at the portions of the end wall face.

Figure 10B:
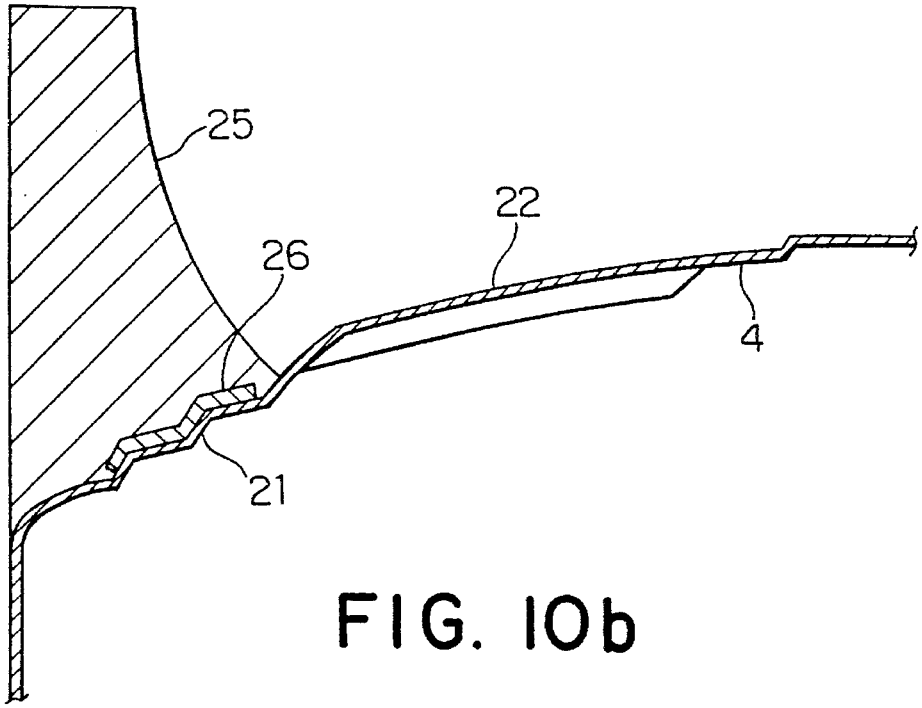
FIG. 10*b* is an enlarged section view of part of the container as shown in FIG. 9*a*.
Figure 10A:
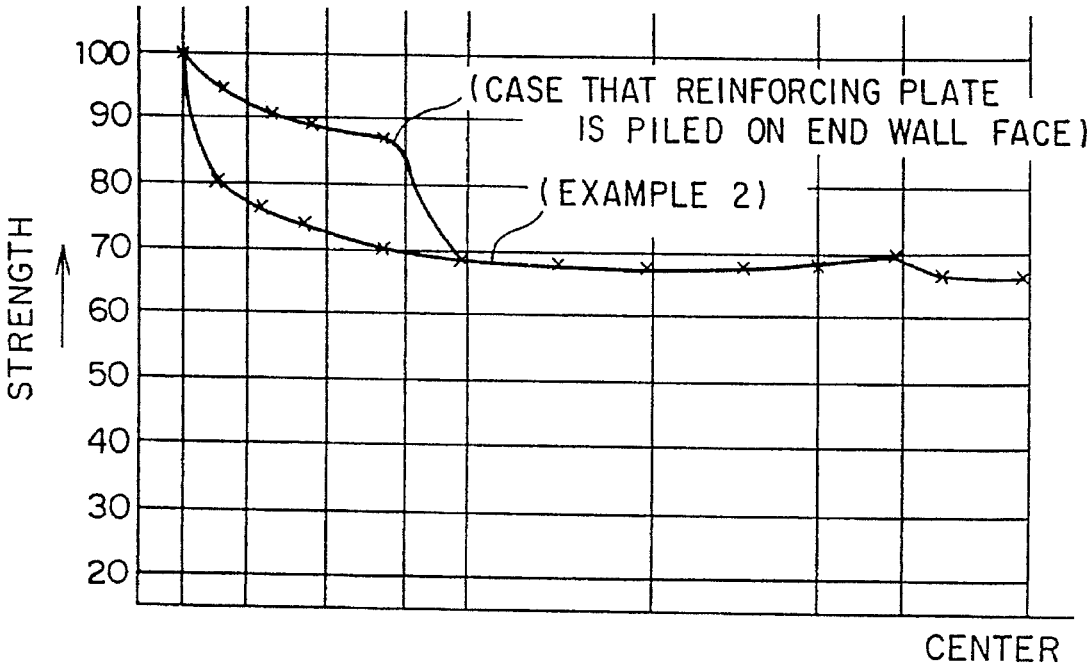
FIG. 10*a* is a graph showing a comparison of strength of an end wall face of a container in which a reinforcing plate is embedded and that of a comparative example.

FIG. 10*a* shows a strength in a case that the reinforcing plate is embedded in the rubber protector as shown in FIG. 10*b*, and a strength of Example 2. As apparent from the drawing, a strength of an end wall of a container to which the rubber protector is embedded with the reinforcing plate as a protector remarkably increases at the fitting region of the rubber protector in comparison with the case in Exmaple 2.

Figure 11:
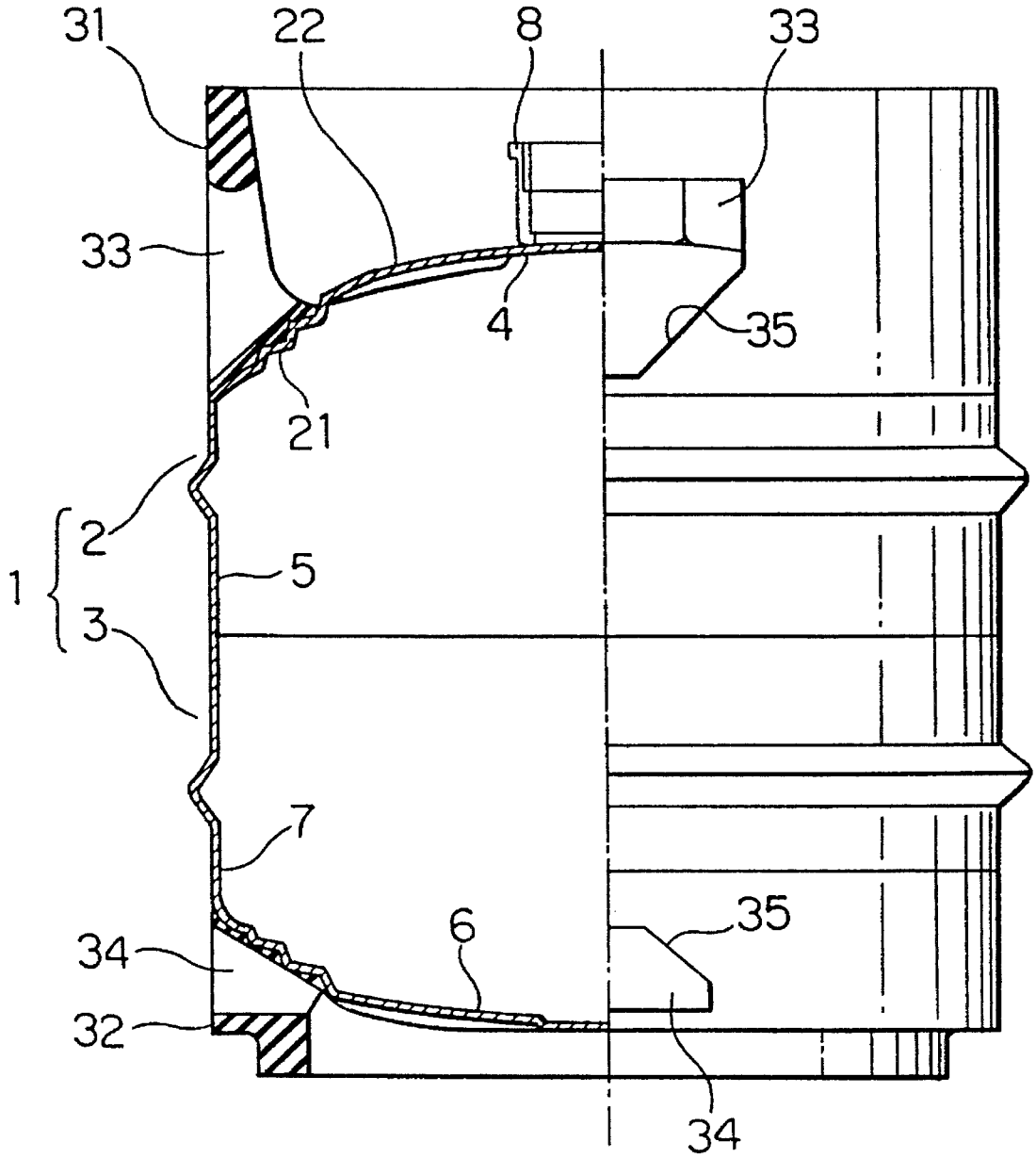
FIG. 11 is a partial sectional front view of an example in which a shape of an opening portion of a rubber protector is improved.

In a case that a rubber protector has an opening portion, the depression of the end wall face can be prevented by improving the shape of the opening portion on top of the treatment of the end wall face. FIG. 11 shows an example that the above improvement is applied to the container body in Example 2. Namely, a rubber protector 31 of this example is fitted to the end wall face of the upper end wall 4 of Example 2 and a rubber protector 32 of this example is fitted to the lower end wall 6 of Example 2. The rubber protector 31 to be fitted to the upper end wall 4 becomes a supporting base to support a container when piled. The upper protector 31 is provided with an opening 33 therethrough. The opening 33 is used as a draining hole as well as a handle at the time of transporting the container. The lower protector 32 which becomes a stand is provided with an opening portion 34 as a draining hole for a case that the container is stored at an inverted posture.

The opening 33 has a size through which fingers can be inserted, as a handle. A standard shape of the opening 33 is a rectangular with a long side disposed horizontally. The lower edge of the opening 33 is provided with rubber overhanging portions 35 which extend from the both sides of the opening 33. Namely, an upper-face of the rubber overhanging portion 35 defines an opening edge of the opening 33, and a lower-face of the overhanging portion is fitted to the container body 1.

Figure 12A:
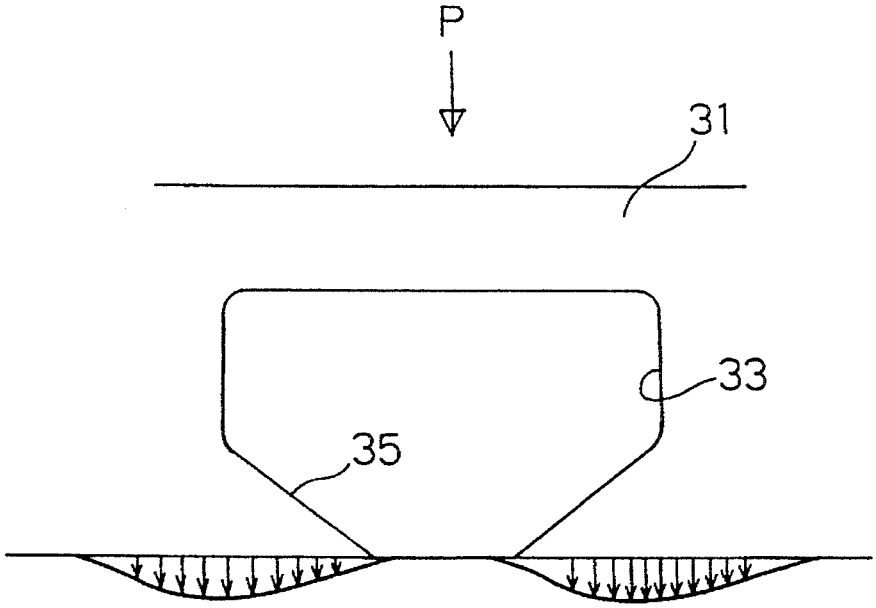
FIGS. 12*a* and 12*b* are views showing load distributions of an end wall face of a container according to the improved rubber protector and of an end wall face of a container of a comparative example.

FIG. 12*a* shows a distribution of load according to the present invention. When a concentrated load is applied to the neighbourhood of the opening 33 from the containers piled above or by another cause, the concentrated load P is dispersed at the fitting face of the rubber protector 31 inclusive of the overhanging portion 35 and the end wall face of the upper end wall 4 of the container body 1 is not affected by the concentrated load, so that any deformation is not formed at the end wall face of the container body 1. Especially, when the treatment for preventing deformation in the circumferential direction and in the radial direction is made by the formation of the ring-shaped rib 21 and the radial ribs 22 on the end wall face of the upper end wall 4, a strength of the end wall face per se increases and thus, the deformation of the container does not cause any problem.

The lower rubber protector 32 is normally low in height in comparison with that of the upper protector 31. The area of the opening portion 34 provided at the lower protector 32 as a draining hole is small. In order to prevent the deformation of the end wall face of the lower end wall 6 of the container body 1 by concentrated load applied to the neighbourhood of the opening portion of the lower protector 32, an overhanging portion 35 which overhangs in the opening portion 34 is provided to disperse the concentrated load, as in the similar way mentioned above.

In this example, the overhanging portion which projects from both sides towards an opening portion of the rubber protector is provided. In the stainless container body to which the rubber protector provided with this overhanging portion is fixed, even though a concentrated load is applied to the neighbourhood of the opening portion, the applied force is dispersed to the overhanging portion and the concentrated load is not applied to a specific portion of the end wall face of the container body. Thus, the deformation of the container body by the depression of the end wall is prevented.

Figure 12B:
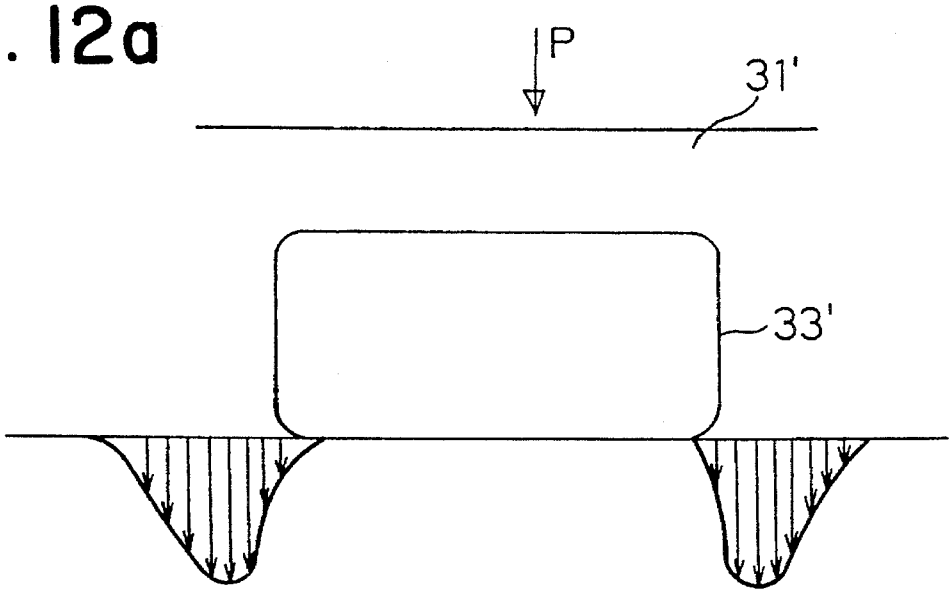

In this point, in a case that the shape of the opening of the protector is a rectangle, as shown in FIG. 12*b*, load P is concentrated at the edges of an opening 33' of a rubber protector 31'. When a great load is applied, it is liable to depress an end wall face of a container.

Figure 13A:
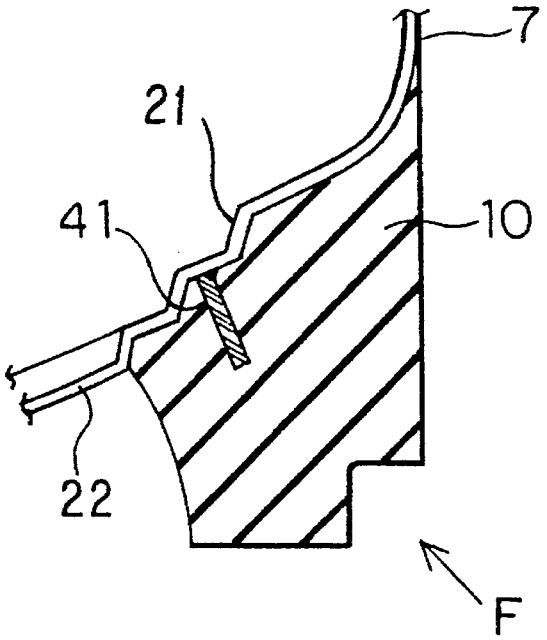
FIG. 13*a* is a partial enlarged sectional view of a fitting portion of a lower protector in which a beam is fitted to an end wall face.
Figure 13B:
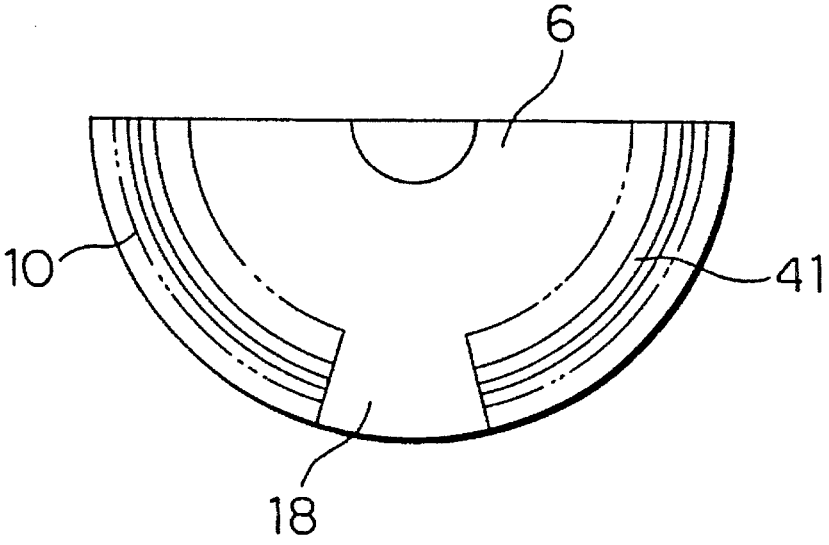
FIG. 13*b* is a plan view showing a part of a lower end wall portion in which a beam is fitted to an end wall face.

In addition to the treatment of work-hardening at the end wall face, it is very convenient to provide continuous beams or girder on the end face wall as a reinforcing treatment from the external face. The beam is welded on the end wall face to increase the strength of the end wall face against the force perpendicularly applied thereto. Since the beam is embedded in the rubber protector, it does not appear at the external face. Although it is preferable to stand up the beam on the end wall face and weld it over the whole circumference of the end wall face, the strength is increased by partially welding arc-shaped segments on the end wall face. An example shown in FIGS. 13*a* and 13*b* shows that the beam is applied to the container body of Example 1. The beam can be similarly provided on Example 2. In FIG. 13*a*, a beam 41 is welded to the outer peripheral region of the face of the lower end wall 6 and this beam 41 is embedded in the rubber protector 10 and the rubber protector 10 extends over the end wall face and a part of the lower girth portion 7 and fixed thereto.

This example explains a case that the beam 41 is provided on the lower end wall 6. It is also possible to provide the beam 41 on the upper end wall.

Figure 14:
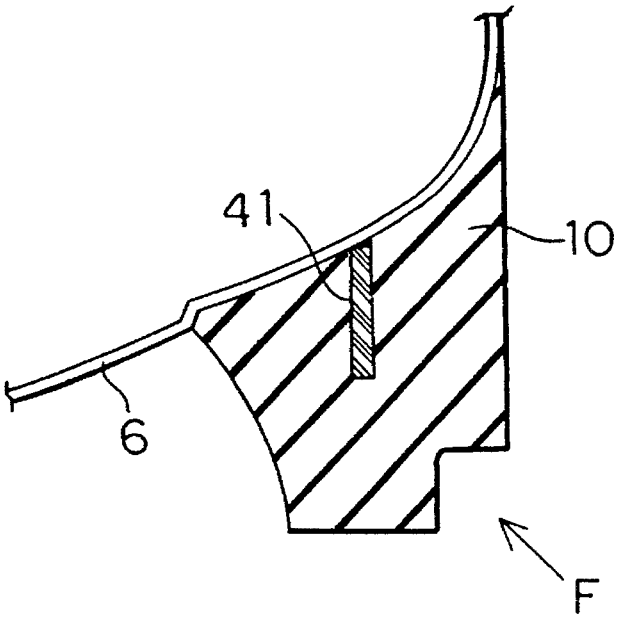
FIG. 14 is an enlarged view of a principal part showing another modification of a beam.

As shown in FIG. 13*a*, the end wall face of the lower end wall 6 has a smooth curved face to be inclined upwardly from the center towards the peripheral edge portion of the lower end wall 6. When the beam is fitted to the end wall face at a right angle, a standing-up portion of the beam which overhangs downwardly is inclined in the direction of an outer face of the rubber protector. However, the angle that the standing-up portion of the beam is constituted with respect to the end wall face is not limited to the above-mentioned example. The beam may be stood up vertically as shown in FIG. 14 or may be inclined inwardly.

Figure 15:
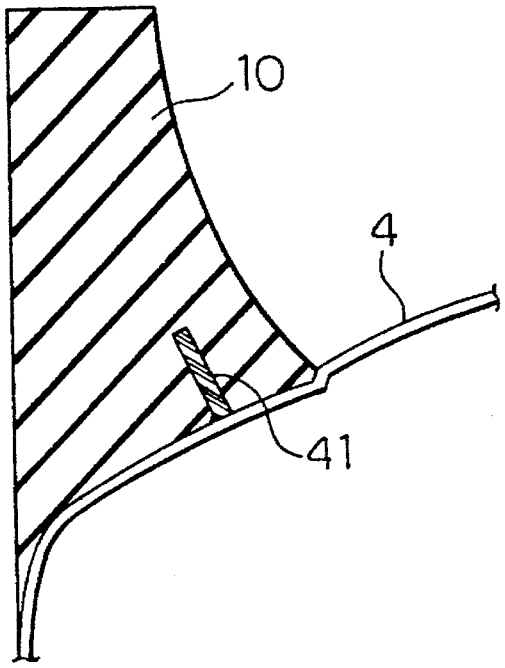
FIG. 15 is an enlarged view of a principal part showing an example in which a beam is fitted to an upper protector.

FIG. 13*b* shows a shape of the beam 41 in a plan view and an arrangement example thereof. The beam 41 is annularly arranged with a standing-up height within the range of the height of the rubber protector 10. However, a draining hole which serves for a handle is formed at an appropriate portion of the protector and thus, it is necessary to fit the beam on the end wall face by excluding the opening portion 18 of the draining hole. Therefore, in fitting of the beam, arc-shaped segments are concentricaly provided on the end wall face. This arrangement is applied to a case that the beam 41 is fitted to the upper end wall. FIG. 15 shows an example that the beam 41 is fitted to the upper end wall.

Figure 16:
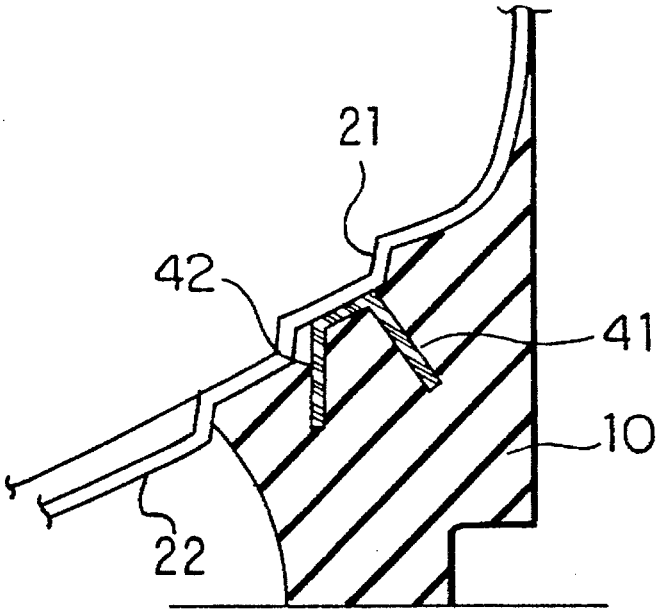
FIG. 16 is an enlarged view of a principal part showing still another modification of a beam.

FIG. 16 is an example that to beams are concentricaly provided. On top of the standing-up portion, the first beam 41 extends towards the outer peripheral side of the end wall face, and a second beam 42 having a standing-up portion projects toward the inner peripheral side of the end wall face.

Figure 17:
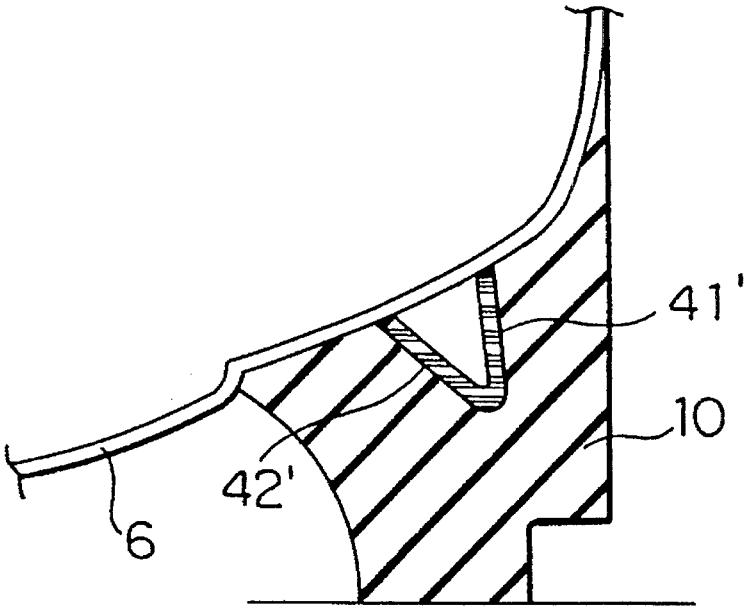
FIG. 17 is an enlarged view of a principal part showing still another modification of a beam.

FIG. 17 shows an example that a beam in a shape of a mountain or V-letter is used. This example corresponds to the structure that the first beam 41' and the second beam 42' are formed. By welding the both ends of the beams in a mountain-shape to the end wall face, the standing-up portions of the first beam 41' and the second beam 42' are supported by each other. Thus, the mechanical strength of the beams themselves are increased. In this case, a space is defined between the both beams 41' and 42', but rubber of the rubber protector 10 is not filled therein.

Figure 18:
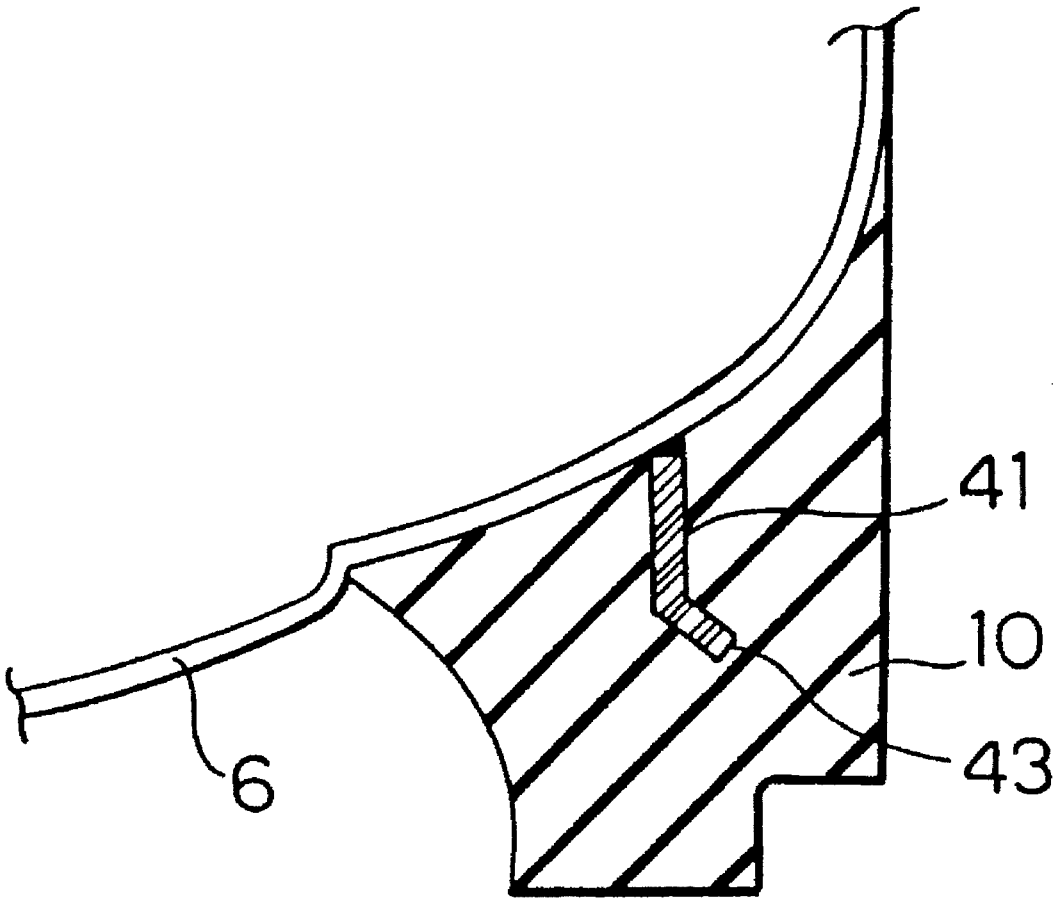
FIG. 18 is an enlarged view of a principal part showing still another modification of a beam.

FIG. 18 shows an example that a bent portion 43 is provided at a standing-up portion of the beam 41. The bent portion 43 with respect to the standing-up portion may be turned to the inside of the end wall face or the outside thereof. By forming the bent portion 43, the strength of the end wall face further increases and the connecting strength of the rubber protector 10 and the beam 41 is raised.

In the above-described examples, it is explained that the beam 41 or beams 41, 41' and 42, 42' are fitted to the end wall face of the lower end wall 6 and are embedded in the rubber protector 10. However, the effects obtained by these examples are entirely the same as in the cases that the beam 41 or the beams 41, 41' and 42, 42' are fitted to the upper end wall 4 and are embedded in the upper protector 10 (FIG. 15) and that the structure of the beams as shown in FIGS. 16 to 18 is applied to the upper end wall. When these structures are applied to the upper protector, it is more effective to protect the deformation of the end all face from a load applied from the upward in piling the containers, an impact or impingement generated by placing the container on a floor in an inverted posture or an impact generated by falling down the container.

According to the above-mentioned examples, as the beams overhanging on the end wall face are welded to the end wall face, the strength of the end wall further increases and deformation and depression of the end wall face can be effectively inhibited. The beam has an annular shape or a circular arc shape, and is welded to the end wall face at a very small part, so that there is no problem when the rubber protector is baked and fitted to the end wall face. Moreover, as the beam is embedded in the rubber protector, it does not appear on the external face.

Figure 19A:
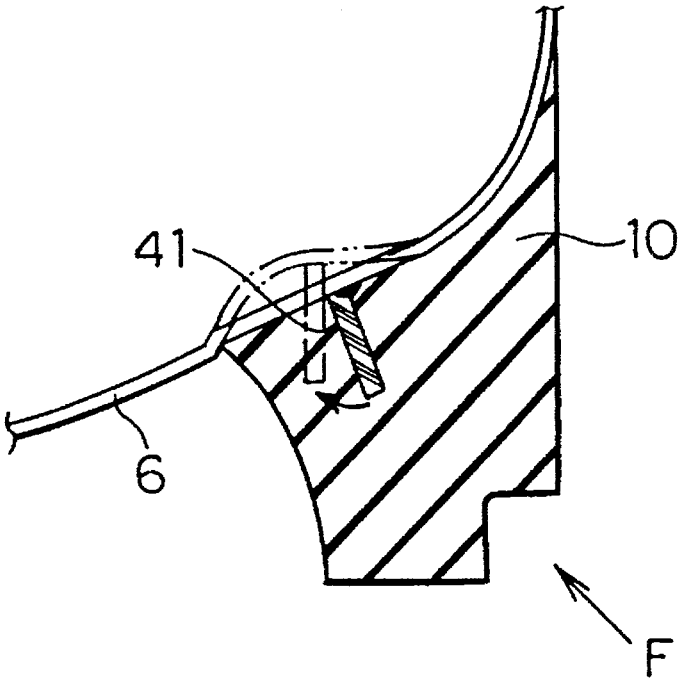
Figure 19B:
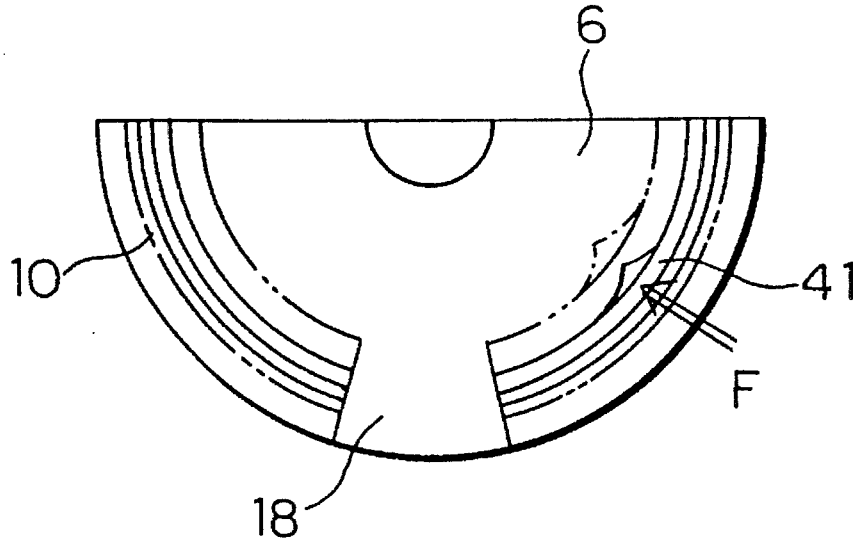

In this connection, it is desirable to further reinforce the beam itself in order to more effectively prevent the depression of the end wall. Even though the beam 41 is provided on the end wall face, if the beam 41 is formed in a form of a simple torus, there may be a case that the beam 41 is bent into the inside of the rubber protector by a local external force F, as shown in FIGS. 19*a*, 19*b* caused when the container is dropped or fallen down to strike the protector to a corner of a concrete building and the like, and as a result, the end wall face is deformed.

Figure 20:
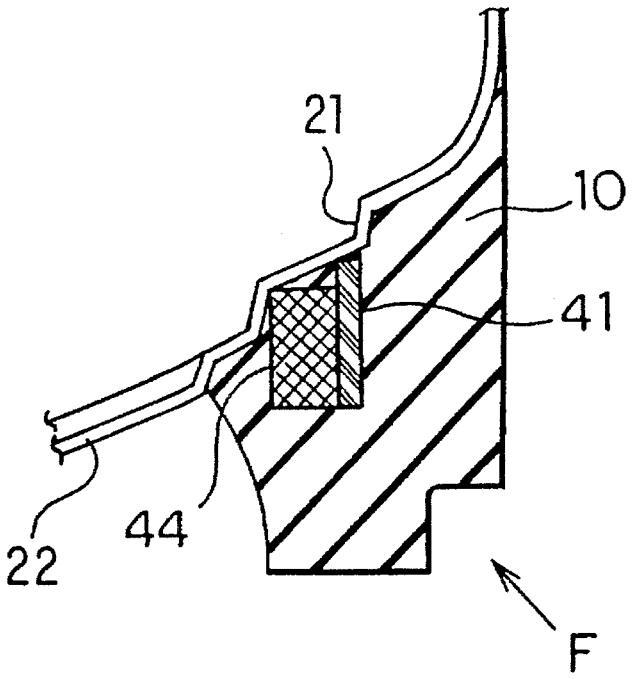
FIG. 20 is an enlarged view of a principal part of a lower protector showing an example in which a reinforcing member is applied to a beam.

Such a phenomenon may be solved by using a beam having a thick thickness. However, in a container such as a beer keg which is limited in shape, dimension, weight, etc., the use of a thick beam causes the increase of weight and therefore, it is difficult to employ the beam having a thick thickness. In this example, a reinforcing material of a light weight and having a rigidity without accompanying the increase of the predetermined weight is inlaid in the inner periphery of the beam so as to be tightly connected thereto and the beam is supported from the inside by this reinforcing member, whereby the strength of the beam is substantially increased. FIG. 20 shows an example that a reinforcing member 44 is provided to the beam 41 of the lower protector of FIG. 14. The reinforcing member 44 is in a shape of torus and is inserted in the inner face of the beam 41 so as to face the inner peripheral side of the end wall face.

Figure 21:
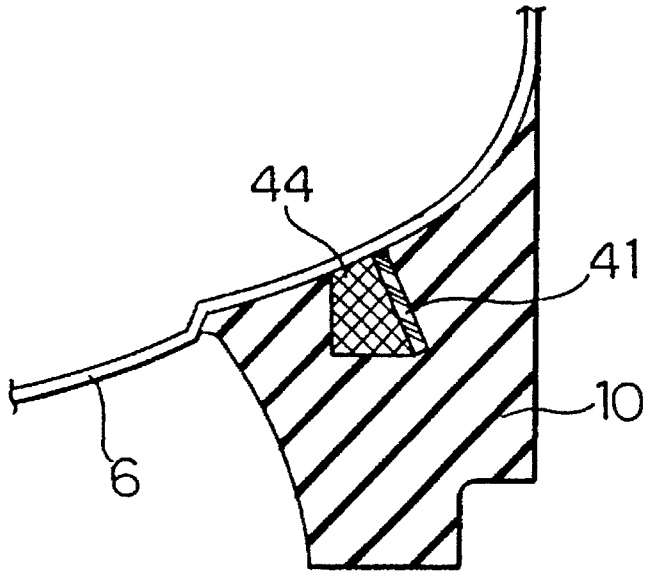
FIG. 21 is an enlarged view of a principal part of a lower protector showing another example in which a reinforcing member is applied to a beam.

In FIG. 20, the sectional shape of the reinforcing member 44 is a rectangle. The shape is not limited to the rectangle and a trapezoid or other square shape may be used if the reinforcing member having such a shape can be tightly contacted to the inner face of the beam 41. In FIG. 21, it is shown an example that the reinforcing member 44 is provided to the beam 41 in the lower protector of FIG. 13*a*. In this example, the sectional shape of the reinforcing member 44 is trapizoid and the inner face of the reinforcing member 44 is stood-up almost perpendicularly by providing the reinforcing member 44 to the inner face of the beam 41 which is inclined in the outer peripheral direction of the rubber protector 10.

As the reinforcing member 44, it is desirable to use FRP as a material. FRP is light in weight, has resilience and is excellent in restoration and is not broken like a metal. When a local external force F is added to the rubber protector 10 in the direction of an arrow shown in FIG. 20 by the drop or falling-down of the container, the force F is applied to the beam 41. However, the force is received by the reinforcing member 44 which supports the inner face of the beam 41 and is dispersed. Further, as the protector is not bent due to a local deformation of the beam 41 itself, a local depression of the end wall face can be prevented.

According to this example, as the strength of the end wall face is increased by the beam 41 as well as the beam is further reinforced by a reinforcing member, it is possible to prevent a local depression of the end wall face and to lighten the weight of the container by using a thin steel plate for the beam due to the provision of the reinforcing member 44.

As mentioned above, the beam which is welded to the end wall face exhibits rigidity integrally with the end wall face of the container body and supports the protector. Accordingly, it is not easy to deform the end wall face even though the container is dropped during transporting or carrying and a great load is locally applied to the rubber protector.

The sectional shape of the beam employs the most suitable one according to the kinds of container. In the beam having a simple shape, the reinforcing member is attached to the inner face of the beam so as to improve the regidity of the end wall face and it is possible to readily increases the rigidity of the end wall face of the container body without changing the shape, dimension, weight and outer appearance of the container.

In each of the above-mentioned examples, according to the use of the stainless steel container, it is possible to provide a shoe having a different hardness from that of the rubber protector on the contacting face of the lower protector which becomes a stand and a supporting base of the upper protector. For example, in a case of a container which is used for the transportation, a shoe having a high hardness is used to easily slide the container and to inhibit the wear of the rubber protector. In a case of the container which is stationarily placed at the predetermined position, it is better to prevent sliding by using a shoe having a low hardness and a great frictional resistance.

The rubber protector is made of a rubber material of HS50° to HS100° and has an impact-absorbing property. The shoe is made by selectively using a rubber material having a high hardness (hardness HS 100° or more) which is higher than that of the rubber protector or a rubber material having a low hardness (hardness HS50° or less) which is lower than that of the rubber protector. When the shoe made of the rubber material having the high hardness is used, sliding resistance becomes low with respect to a floor face and the like and the container can slide easily.

The shoe made of a rubber material having a low hardness has great sliding-resistance and has a tackiness and therefore, the container provided with this type of shoe does not slide easily. The thickness of the shoe is suitable in 5 to 10 mm, but the thickness can be freely determined according to the thickness and diameter of the rubber protector.

Figure 22:
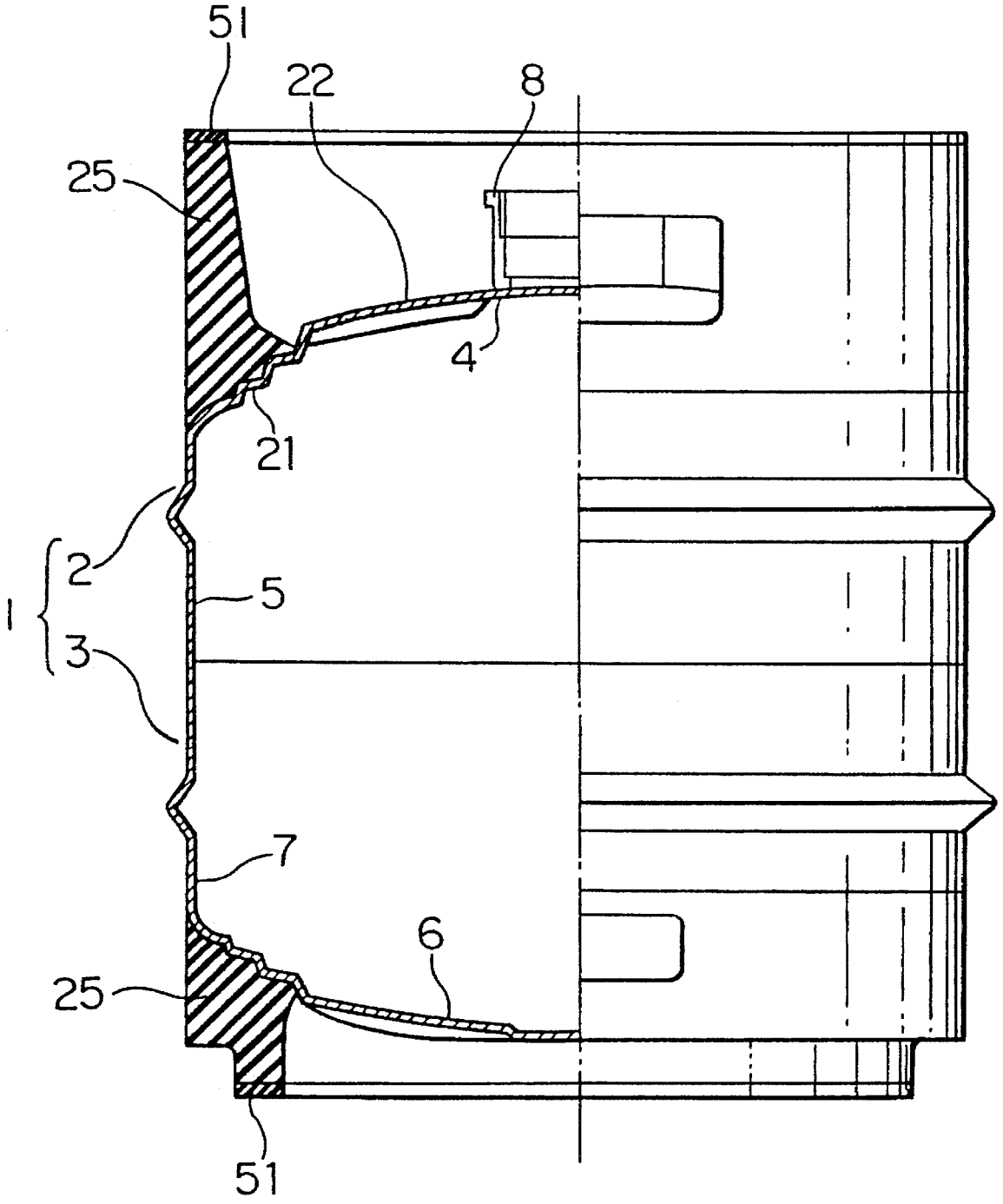
FIG. 22 is a partial sectional view of a container body, in which a rubber protector is provided with a shoe.
Figure 23:
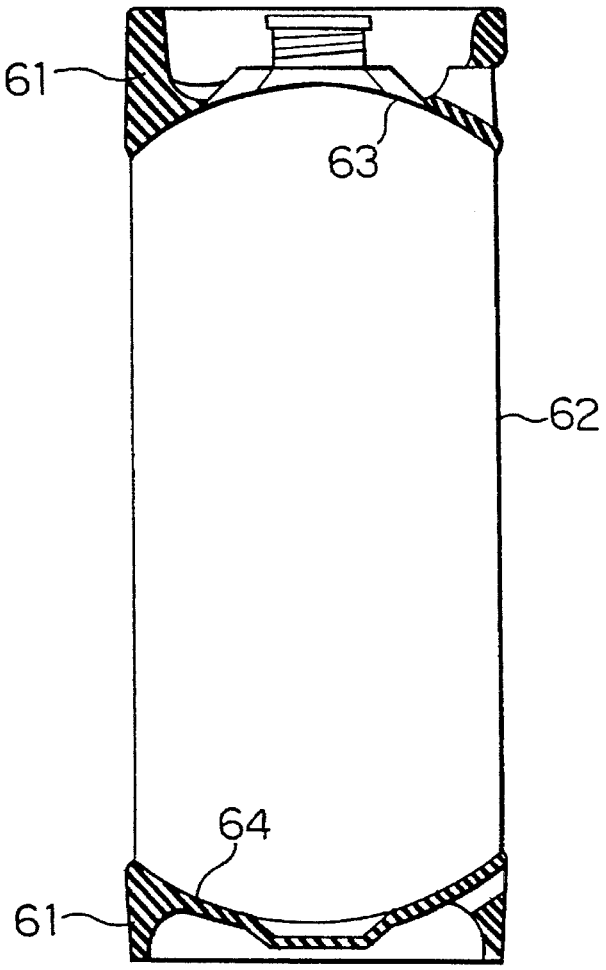
FIG. 23 PRIOR ART
FIG. 23 is a view showing an example of a conventional keg for transportation which has a rubber protector.
Figure 24:
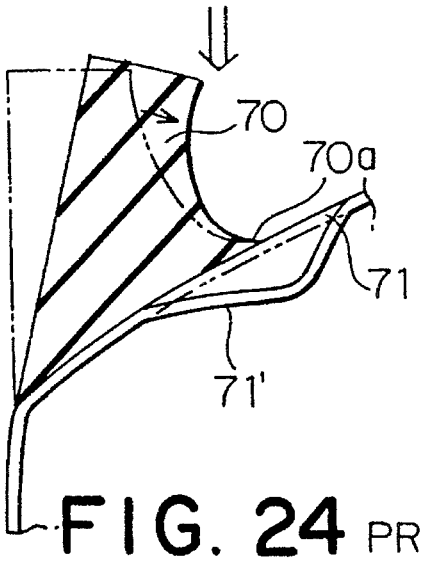
FIG. 24 PRIOR ART
FIG. 24 is a view showing a problem caused when a rubber protector is fitted to a beer keg.

FIG. 22 shows an example that shoes 51 are fitted to upper and lower rubber protectors 25 of a container body 1 of the Example 2. The shoe 51 is an unvulcanized ring which is previously formed in a ring shape and is integrally molded with the rubber protector 25 and is subjected to the valcanization treatment.

The container as shown in FIG. 22 is used for transporting or carrying, so that it is suitable to use a rubber material having a high hardness as a shoe. It is a matter of course that a rubber material having a great frictional resistance and a low hardness is applied to a container which is stationarily placed at a predetermined position.

As explained above, according to the examples of the present invention, a shoe having a different hardness from that of the rubber protector is integrally mounted on an outer end surface of the rubber protector, but it is possible to change the hardness of the outer end surface of the rubber protector without losing the impact-absorbing property of the rubber protector, according to various uses. By using the rubber material having a high hardness than that of the rubber protector as the shoe, an impact from the external force is dispersed to the rubber protector via the shoe and is absorbed at the rubber protector and therefore, the container body can be protected from the impact. When a rubber material having a lower hardness than that of the rubber protector after the valcanization as a raw material of the shoe is used, the sliding resistance becomes large and the container is stationarily placed stably and is very suitable to be applied as a protector of a container to be stationarily placed.

While the invention has been explained with reference to the specific examples of the invention, the explanation is illustrative and the invention is limited by the appended claims.

What is claimed is:

1. A metal container for storing liquid therein, comprising:

a cylindrical container body made of a metal plate, and having a cylindrical girth portion and upper and lower end walls at longitudinal ends of the girth portion, a hardened region formed on at least one of the upper and lower end walls to harden the same for preventing deformation of the end wall, said hardened region including at least one annular stepped portion provided in a middle of the end wall to form an inner portion and an outer portion relative to the stepped portion, and a plurality of radial ribs formed in the inner portion and extending radially outwardly from a center portion thereof said inner portion being located axially outwardly relative to the outer portion along a longitudinal axis of the cylindrical girth portions, said annular stepped portion having an inclined surface and a rubber protector fixed onto the end wall with the hardened region and extending from an end of the girth portion to the inclined surface of the end wall with the hardened region, said rubber protector preventing deformation of the end wall.

2. A metal container according to claim 1, wherein said hardened region includes a plurality of annular stepped portions concentrically arranged and spaced apart from each other to strengthen the end wall.

3. A metal container according to claim 2, wherein said rubber protector extends over the plurality of annular stepped portions and terminates at the inclined surface of an innermost stepped portion.

4. A metal container according to claim 1, further comprising a reinforcing plate embedded in the rubber protector, said reinforcing plate having a stepped portion with a shape corresponding to that of the end wall and placed over the stepped portion of the end wall.

5. A metal container according to claim 1, wherein said rubber protector includes an opening operating as a handle and a draining hole for the container, and an overhanging portion extending from the opening the girth portion, said overhanging portion having two inclined surfaces converging toward each other so that force applied to the rubber protector through the opening is transferred to the cylindrical body through the overhanging portion.

6. A metal container according to claim 1, further comprising a beam fixed to an outer surface of the end wall with the hardened portion, said beam being embedded inside the rubber protector to strengthen the end wall and the rubber protector.

7. A metal container according to claim 6, wherein said beam has an annular shape and projects outwardly from the end wall.

8. A metal container according to claim 7, wherein said beam has two projections radially spaced apart from each other.

9. A metal container according to claim 7, wherein said beam further includes a reinforcing member situated radially inwardly of the beam to prevent deformation of the beam over the end wall.

10. A metal container according to claim 1, wherein said rubber protector includes a shoe mounted on an outer end surface of the rubber protector, said shoe having hardness different from that of the rubber protector.

11. A metal container according to claim 10, wherein said shoe has a sliding property so that the container slides easily.

12. A metal container according to claim 1, wherein said cylindrical container body is made of an austenite stainless steel and is formed of first and second bodies, each body having a cylindrical portion with the end wall, said container body being formed by connecting the cylindrical portions of the first and second bodies.

13. A metal container according to claim 12, wherein said rubber protector is fitted onto one side of the container body, the other side of the container body having a stainless steel protector integrally formed with one of the first and second bodies.

* * * * *